US008791390B2

(12) United States Patent
Taniguchi

(10) Patent No.: US 8,791,390 B2
(45) Date of Patent: Jul. 29, 2014

(54) IMAGE HEATING APPARATUS

(75) Inventor: Satoru Taniguchi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 41 days.

(21) Appl. No.: 13/560,392

(22) Filed: Jul. 27, 2012

(65) Prior Publication Data

US 2013/0026154 A1 Jan. 31, 2013

(30) Foreign Application Priority Data

Jul. 29, 2011 (JP) ..... 2011-166699

(51) Int. Cl.
*G03G 15/20* (2006.01)
*H05B 1/02* (2006.01)

(52) U.S. Cl.
USPC ..... 219/216; 219/486; 219/508; 399/67; 399/329

(58) Field of Classification Search
None
See application file for complete search history.

(56) References Cited

U.S. PATENT DOCUMENTS 5,229,577 A * 7/1993 Matsuura et al. ..... 219/497
6,870,140 B2 * 3/2005 Cook et al. ..... 219/486
7,193,180 B2 * 3/2007 Cook et al. ..... 219/216
7,277,654 B2 * 10/2007 DeMoor et al. ..... 399/88
2004/0232137 A1 * 11/2004 Cook et al. ..... 219/486
2004/0245236 A1 * 12/2004 Cook et al. ..... 219/216
2009/0230114 A1 9/2009 Taniguchi et al.
2012/0308252 A1 * 12/2012 Shimura ..... 399/67

FOREIGN PATENT DOCUMENTS

JP 07-199702 A 8/1995
JP 2008-3469 A 1/2008
JP 2008003469 A * 1/2008

* cited by examiner

*Primary Examiner* — Joseph M Pelham
(74) *Attorney, Agent, or Firm* — Fitzpatrick, Cella, Harper & Scinto

(57) ABSTRACT

An image heating apparatus includes an endless belt; first, second, third and fourth resistors having resistances R1, R2, R3 and R4, arranged in this order from an upstream side in a feeding direction of the recording material, and R1=R2 and R3=R4. The connection state of the resistors is switchable between a first state in which the first and second resistors are connected in parallel, the third and fourth resistors are connected in parallel, and a set of the first and second resistors and a set of the third and fourth resistors are connected in parallel, and a second state in which the first resistor second resistors are connected in series, the third and fourth resistors are connected in series, and a set of the first and second resistors and a set of the third and fourth resistors are connected in parallel.

8 Claims, 12 Drawing Sheets

A) 100V

B) 200V

A) 100V

B) 200V

A) 100V

B) 200V

IMAGE HEATING APPARATUS

FIELD OF THE INVENTION AND RELATED ART

The present invention relates to an image heating apparatus which is suitable as a fixing apparatus (device) to be installed in an image forming apparatus such as an electrophotographic copying machine, an electrophotographic printer, or the like.

One of the fixing apparatuses (devices) which have been known to be installed in an electrophotographic copying machine, an electrophotographic printer, or the like is a fixing apparatus which heats an image through film. A fixing apparatus which heats an image through film has a heater, a fixation film, and a pressure roller. The heater is made up of a ceramic substrate, and a heat generation resistor which is on the substrate. It generates heat as electric current is flowed through the heat generation resistor. The fixation film is cylindrical (endless) and is circularly moved in contact with the heater. The pressure roller forms a nip (fixation nip) by being pressed against the heater with the presence of the fixation film between itself and the heater. In operation, a sheet of recording medium on which an unfixed toner image is present is conveyed through the nip, remaining pinched by the film and pressure roller, the sheet and the unfixed toner image thereon are heated. Thus, the unfixed toner image on the sheet is thermally fixed to the sheet.

A fixing apparatus of the above-described type is meritorious in that it is substantially shorter than a fixing apparatus of a type different from the above described one, in the length of time it takes for the temperature of the apparatus to rise to a level high enough for fixing an unfixed image after electric current begins to be flowed through the heater. Thus, a printer which employs a fixing apparatus of the above described type is substantially shorter than a fixing apparatus of a type different from the above described type, in the length of time (FPOT: First, Print, Out Time) it takes for a printer to output the first image after the printer receives a print command. Further, a fixing apparatus of the above-described type is also meritorious in that it is substantially smaller than a fixing apparatus of the other type, in the amount of electricity which a fixing apparatus consumes white it is kept on standby for the next print command.

An image forming apparatus is used in various regions of the world. For example, it is used in regions such as Japan or North America in which the voltage of the ordinary commercial power source is 100 V, and also, in a region such as Europe or China in which the voltage of the ordinary commercial power source is 200 V. Thus, in order to enable a heater for a fixing device to be stable in the amount of heat generation regardless of the power source voltage, the heater for the image forming apparatus to be used in the region in which the voltage of the ordinary commercial power source is 100 V, and the heater for the image forming apparatus to be used in the region in which the voltage of the ordinary commercial power source is 200 V, have to be different in the value of the electrical resistance of the heater of the fixing apparatus. Thus, two types of heater are required, that is, a heater for a power supply which is 100 V in voltage, and a heater for a power supply which is 200 V in voltage, which results in an increase in the cost for manufacturing a fixing apparatus.

There have been proposed various solutions to this problem. For example, a couple of solutions are disclosed in Japanese Laid-open Patent Application H07-199702 and Japanese Laid-open Patent Application 2008-3469. According to these applications, the heater is provided with two heat generation resistors which can be connected in series or in parallel according to the voltage of a commercial power source. This method makes it possible to provide a heating apparatus (device) which can be used in a 100 V region as well as a 200 V region. Recent years, an image forming apparatus has been increased speed. At the same time, consumers have begun to desire an image forming apparatus which is small in power consumption. That is, demand has been increasing for a fixing apparatus which is high in fixation efficiency, that is, a fixing apparatus which is excellent in fixation, and yet, is low in power consumption.

Regarding a fixing apparatus which heats an unfixed toner image through film, more specifically, the temperature distribution of the heater of the fixing apparatus, in terms of the direction in which a sheet of recording medium is conveyed through the fixing apparatus during the fixation of a toner image, the peak of the temperature distribution tends to shift downstream in terms of the recording medium conveyance direction, for the following reason. That is, while a fixing apparatus is in operation, both its fixation film and pressure roller are rotating. Therefore, the heat from the heater is carried downstream in terms of the recording medium conveyance direction, by the film and roller.

When the peak of the temperature distribution of the fixation nip of a fixing apparatus is on the downstream side of the center of the fixation nip in terms of the recording medium conveyance direction during a thermal fixing operation, the fixing apparatus cannot efficiently transfer heat onto a sheet of recording medium. Thus, the amount by which electric power is consumed by the fixing apparatus in order to ensure that the unfixed toner image on a sheet of recording medium is satisfactorily fixed to the sheet is greater than the amount necessary when the peak is at the center of the fixation nip. In other words, the fixing apparatus is lower in fixation efficiency. Thus, from the standpoint of fixation efficiency, a fixing apparatus which heats an unfixed toner image through film is desired to be structured so that when the film is being circularly moved, the peak of the temperature distribution of its fixation nip in terms of the recording medium conveyance direction remains in the adjacencies of the center of the fixation nip in terms of the recording medium conveyance direction.

One of the methods for keeping the peak of the temperature distribution of the fixation nip of a fixing apparatus in the adjacencies of the center of the fixation nip in terms of the recoding medium conveyance direction is to provide the fixing apparatus with two or more heat generation resistors which are different in the value of their electrical resistance, and to structure the fixing apparatus so that the heat generation resistors are positioned in parallel in the lengthwise direction of the substrate of the heater, that is, the direction perpendicular to the recording medium conveyance direction, and also. This method has been put to practical use.

For example, in a case where two heat generation resistors are serially connected, the upstream heat generation resistor in terms of the recording medium conveyance direction is made higher in electrical resistance than the downstream one so that the upstream heat generation resistor becomes greater in the amount of heat generation than the down stream one. Hereafter, the upstream and downstream heat generation resistors in terms of the recording medium conveyance direction may be referred to simply as the "upstream" and "downstream" heat generation resistors, respectively. By structuring a fixing apparatus so that the upstream heat generation resistor is greater in the amount of heat generation than the downstream one, it is possible to keep the peak of the temperature distribution in the fixation nip in the adjacencies of the center portion of the fixation nip, in terms of the recording medium conveyance direction, in order to keep the fixing apparatus highest in fixation efficiency.

However, it is not easy to apply the above described method for keeping the peak of the temperature distribution in the fixation nip in the adjacencies of the center of the fixation nip in terms of the recording medium conveyance direction, to a fixing apparatus such as the above described one which can be used in both the above described 100 V region and 200 V region. For example, in a case where a fixing apparatus is structured so that it is provided with a pair of heat generation resistors which are serially connected (to be used in 200 V region), and also, so that its upstream heat generation resistor is higher in electrical resistance than the downstream one, the upstream heat generation resistor is greater in the amount of heat generation than the downstream one, and therefore, the peak of the temperature distribution in the fixation nip remains in the adjacencies of the center of the fixation nip. However, if this fixing apparatus is connected to a power source which is 100 V in voltage, the two resistors have to be connected in parallel. However, the upstream heat generation resistor is higher in electrical resistance than the downstream one. Therefore, the downstream resistor becomes greater in the amount of heat generation than the upstream one. Therefore, the peak of the temperature distribution in the fixation nip will be substantially offset from the center of the fixation nip.

SUMMARY OF THE INVENTION

Thus, the primary object of the present invention is to provide an image heating apparatus which is usable with any of multiple (two) power sources different in voltage, and is higher in the efficiency with which an image on a sheet of recording medium can be heated, than any image heating apparatus in accordance with the prior art.

According to an aspect of the present invention, there is provided an image heating apparatus comprising an endless belt; a heater contacting an inner surface of said endless belt and having a substrate and a plurality of heat generating resistors for generating heat using commercial electric power; and a pressing member for cooperating with said heater through said endless belt to form a nip for nipping and feeding a recording material; wherein said heater includes a first heat generating resistor having a resistance R1, a second heat generating resistor having a resistance R2, a third heat generating resistor having a resistance R3 and a fourth heat generating resistor having a resistance R4, arranged in the order named from an upstream side in a feeding direction of the recording material, and R1=R2 and R3=R4, wherein a connection state of said heat generating resistors is switchable between a first connection state in which said first heat generating resistor and said second heat generating resistor are connected in parallel, said third heat generating resistor and said fourth heat generating resistor are connected in parallel, and a set of said first heat generating resistor and said second heat generating resistor and a set of said fourth heat generating resistor are connected in parallel, and a second connection state in which said first heat generating resistor and said second heat generating resistor are connected in series, said third heat generating resistor and said fourth heat generating resistor are connected in series, and a set of said first heat generating resistor and said second heat generating resistor and a set of said fourth heat generating resistor are connected in parallel.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Embodiment 1

(1) Image Forming Apparatus

Figure 12:
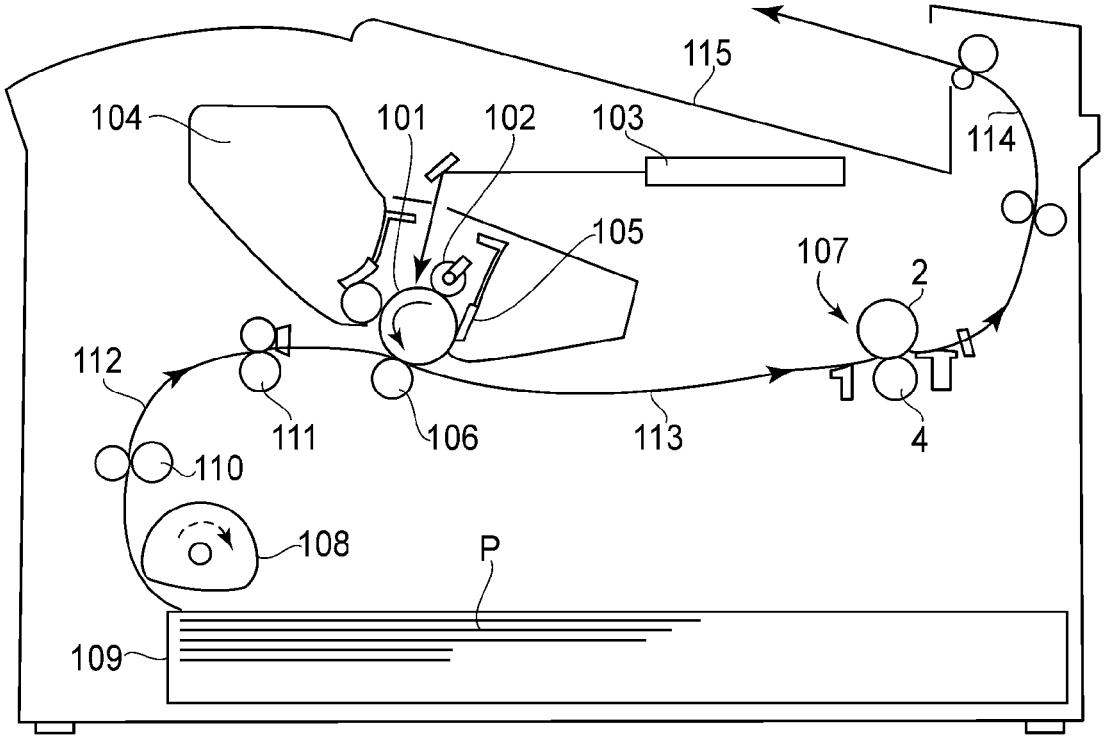
FIG. 12 is a schematic sectional view of an example of an image forming apparatus to which the present invention is applicable, and shows the general structure of the apparatus.

FIG. 12 is a schematic sectional view of an example of an image forming apparatus in which an image heating apparatus in accordance with the present invention is installable as an image heating device. It shows the general structure of the apparatus. This image forming apparatus is a laser printer, that is, an electrophotographic image forming apparatus of the direct transfer type. The dimension of the widest sheet of recording medium in terms of the direction perpendicular to the recording medium conveyance direction of this image forming apparatus is equivalent to the dimension (210 mm) of an A4 sheet of paper.

Figure 13:
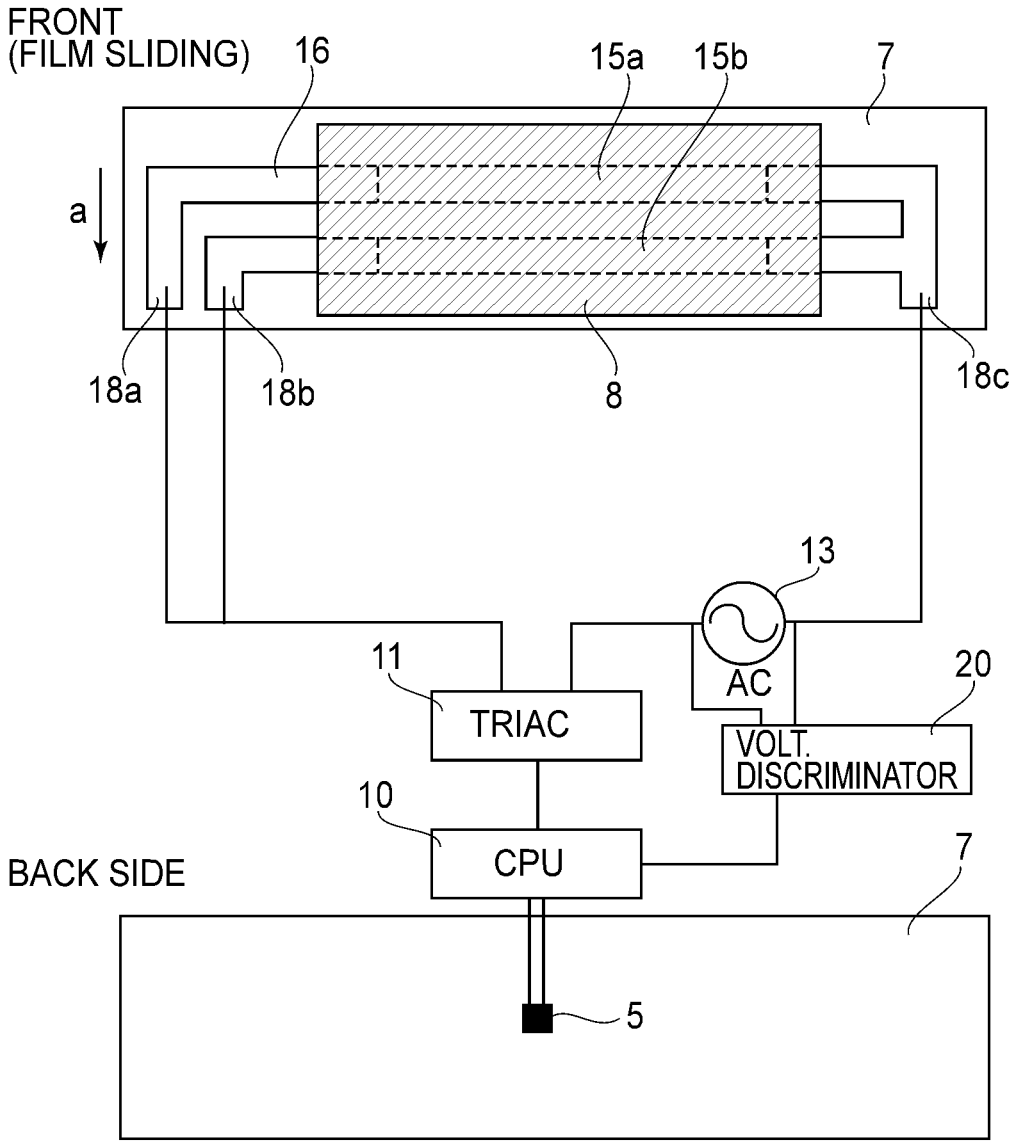
FIG. 13 is a combination of a plan view of the heater of a comparative fixing apparatus (fixing apparatus in accordance with prior art), and a current control circuit of the heater.

Referring to FIG. 13, a referential code 101 stands for an electrophotographic photosensitive drum as an image bearing member (which hereafter may be referred to simply as photosensitive drum). This photosensitive drum 101 is rotated in the direction indicated by an arrow mark at a preset peripheral velocity (process speed), by a motor (unshown) which is driven in response to a print command.

Designated by a referential code 102 is a charge roller of the contact type (which hereafter will be referred to simply as charge roller) as a charging means. This charge roller 102 uniformly charges the peripheral surface of the photosensitive drum 101 to a preset polarity and a preset potential level.

A referential code 103 stands for a laser scanner as a drum exposing means. This laser scanner 103 scans (exposes) the uniformly charged area of the peripheral surface of the photosensitive drum 101, with a beam of laser light which it emits while turning on and off the beam according to the information of an image to be formed, which is inputted from an external device (unshown) such as an image scanner, a computer, or the like. As a given point of the uniformly charged area of the peripheral surface of the photosensitive drum 101 is exposed to (scanned by) the beam of laser light, electrical charge is removed from this point. As a result, an electrostatic latent image, which reflects the information of the image to be formed, is effected on the peripheral surface of the photosensitive drum 101.

Designated by a referential code 104 is a developing apparatus (device) as a developing means. This developing device 104 develops the electrostatic latent image on the peripheral surface of the photosensitive drum 101. More specifically, the developing device 104 has a development sleeve. As the development sleeve is rotated with the photosensitive drum 101, toner (developer) is supplied from the development sleeve to the peripheral surface of the photosensitive drum 101. As a result, the latent image on the peripheral surface of the photosensitive drum 101 is turned into an image formed of toner (developer). Generally speaking, a laser printer like the one in this embodiment reversely develops an electrostatic latent image. That is, it adheres toner to exposed points (light points) of the peripheral surface of the photosensitive drum 101.

A referential code 109 stands for a cassette for feeding a sheet of recording medium into the main assembly of the laser printer. This cassette 109 is capable of storing in layers a substantial number of sheets P of recording medium. The feed roller 108 of the cassette 109 is rotated in response to a sheet feeding start signal, whereby the sheets P in the cassette 109 are fed one by one, while being separated from the rest, into the main assembly of the printer. Then, each sheet P of recording medium is conveyed through a sheet passage 112, which includes a sheet conveyance roller 110, a pair of registration rollers 111, etc., and is introduced into a transfer nip, that is, the area of contact between the peripheral surface of the photosensitive drum 101 and the peripheral surface of a transfer roller 106, with a preset timing. That is, the conveyance of each sheet P of recording medium is controlled by the pair of registration rollers 111 so that the leading edge of the sheet P arrives at the transfer nip at exactly the same time as the leading edge of the toner image on the peripheral surface of the photosensitive drum 101.

As a sheet P of recording medium is introduced into the transfer nip, it is conveyed through the nip while remaining pinched between the peripheral surface of the photosensitive drum 101 and the peripheral surface of the transfer roller 106. White the sheet P is conveyed through the transfer nip, a preset transfer voltage (transfer bias), which is opposite in polarity from the toner charge, is applied to the transfer roller 106 from a transfer bias application power source (unshown). Thus, the toner image on the peripheral surface of the photosensitive drum 101 is electrostatically transferred onto the sheet P in the transfer nip.

After the toner image is transferred onto a sheet P of recording medium in the transfer nip, that is, after the toner image is borne by the sheet P, the sheet P is separated from the peripheral surface of the photosensitive drum 101, is conveyed to a fixing device 107 through a sheet passage 113, and is introduced into the fixing device 107. Then, the sheet P and the toner image thereon are conveyed through the fixing device 107 while being subjected to heat and pressure. As a result, the toner image becomes fixed to the sheet P.

After the separation of the sheet P from the peripheral surface of the photosensitive drum 101 (after transfer of toner image onto sheet P), the peripheral surface of the photosensitive drum 101 is cleaned by a cleaning device 105; the transfer residual toner, paper dust, and the like contaminants on the peripheral surface of the photosensitive drum 101 are removed by the cleaning device 105 so that the peripheral surface of the photosensitive drum 101 can be repeatedly used for image formation.

After the sheet P is conveyed through the fixing device 107, it is further conveyed through a sheet passage 114, and then, is discharged into a delivery tray 115 through a sheet outlet of the main assembly of the printer (image forming apparatus).

(2) Fixing Device (Image Heating Device) 107

In the following description of the fixing device 107, the "lengthwise direction" of the fixing device 107 and the structural components of the fixing device 107 means the direction perpendicular to the recording medium conveyance direction, and the "widthwise direction" of the fixing device 107 and the structural components of the device 107 means the direction parallel to the recording medium conveyance direction. The "length" of the fixing device 107 and the structural components of the device 107 means their measurement in terms of the "lengthwise direction," and the "width" of the fixing device 107 and the structural components of the device 107 means their measurements in terms of the "widthwise direction".

Figure 1:
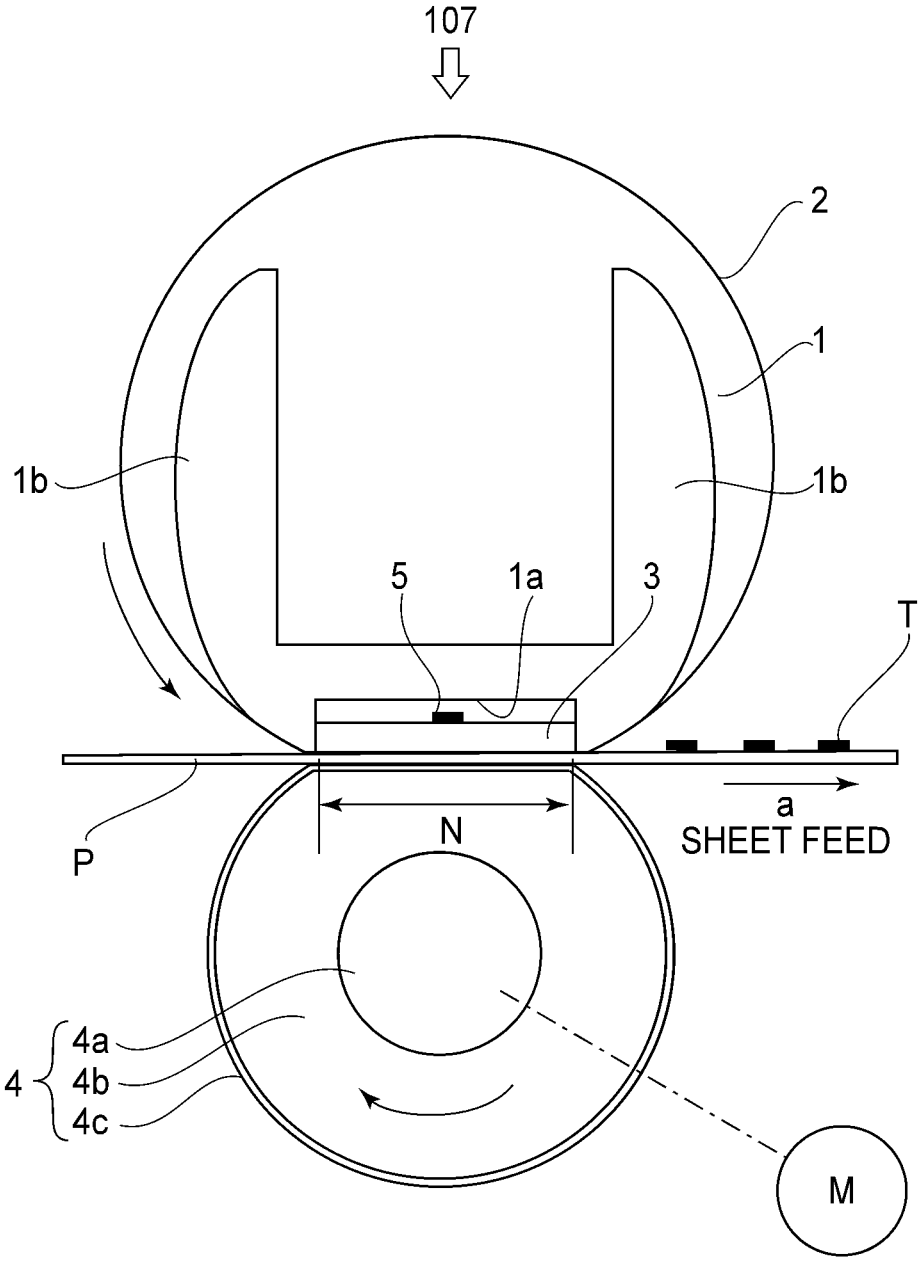
FIG. 1 is a sectional view of the fixing apparatus in the first embodiment of the present invention, at a plane perpendicular to the lengthwise direction of the apparatus, and shows the general structure of the apparatus.

FIG. 1 is a schematic sectional view of the fixing device 107 in this embodiment, at a plane parallel to the recording medium conveyance direction of the device 107. It shows the general structure of the device 107. This fixing device 107 heats a toner image through film. It has an endless belt which is formed of flexible and heat resistant film. It is structured so that its heat resistant endless film is circularly moved by the rotation of its pressure applying member, and also, so that the endless film is allowed to be free of tension (in state in which endless film is under no tension) at least within a preset range of its circular path.

The fixing device 107 in this embodiment has: a heater holder as a heater supporting member which is heat resistant; and a fixation film 2, which is flexible and endless (cylindrical). It has also: a ceramic heater 3 (which hereafter will be referred to simply as heater) as a heating member; a pressure roller 4 as a pressure applying member; etc. . . . The lengthwise direction of the heater holder 1, fixing film 2, heater 3, and pressure roller 4 coincides with the lengthwise direction of the fixing device 107.

(2-1) Heater Holder (Supporting Member) 1

The heater holder 1 is roughly U-shaped in cross section. It has a groove 1*a*, which is in the bottom portion of the holder 1. The groove 1*a* is in the middle of the holder 1 in terms of the widthwise direction of the holder 1. It extends in the lengthwise direction of the holder 1. The heater holder 1 supports the heater 3 in such a manner that the heater 3 fits in the groove 1*a*, with the overcoat layer 8 of the heater 3 facing downward. As for the material for the heater holder 1, highly heat resistant resin such as polyimide, polyamide, PEEK, PPS, liquid polymer, etc., can be used. In addition, a combination of one or more of these resins and ceramic, metal, glass, or the like can also be used as the material for heater holder 1. The substance used as the material for the heater holder 1 in this embodiment is liquid polymer.

The fixation film 2 is loosely fitted around the heater holder 1 by which the heater 3 is held. The fixing device 107 is structured so that the circumference of the inward surface of the fixation film 2 is roughly 3 mm larger than the circumference of the heater holder 1 by which the heater 3 is held. That is, the fixation film 2 is fitted around the heater holder 1, with the presence of a substantial amount of play. The heater holder 1 is held by the pair of lateral frames (unshown) of the fixing device 107, with the lengthwise ends of the heater holder 1 solidly attached to the lateral frames, one for one. The heater holder 1 is provided with a pair of projections 1*b* which project from the widthwise ends of the heater holder 1, one for one, in the direction perpendicular to the lengthwise direction of the heater holder 1. Each projection 1*b* is roughly crescent in cross section, and is positioned so that its surface with curvature faces the inward surface of the fixation film 2 to guide the fixation film 2 as the film 2 is circularly moved.

(2-2) Fixation Film 2 (Flexible Member)

The fixation film 2 needs to be capable of quickly heat up. Therefore, it needs to be small in thermal capacity. Thus, it is desired to be no more than 100 μm in thickness, preferably, in a range of 20 μm-50 μm. As the material for the fixation film 2, single-layer film of heat resistant PTFE, PFA, FEP, or the like, or multilayer film made by coating film of polyimide, polyamide, PEEK, PES, PPS or the like, as a substrate layer, with PTFE, PFA, FEP or the like, can be used. The material for the fixation film 2 in this embodiment is multilayer film made by coating the outwardly facing surface of endless polyimide film which is rough 50 μm in thickness, with PTFE. The fixation film 2 is 30 mm in external diameter, and 235 mm in length.

(2-3) Heater 3 (Heating Member)

Figure 2:
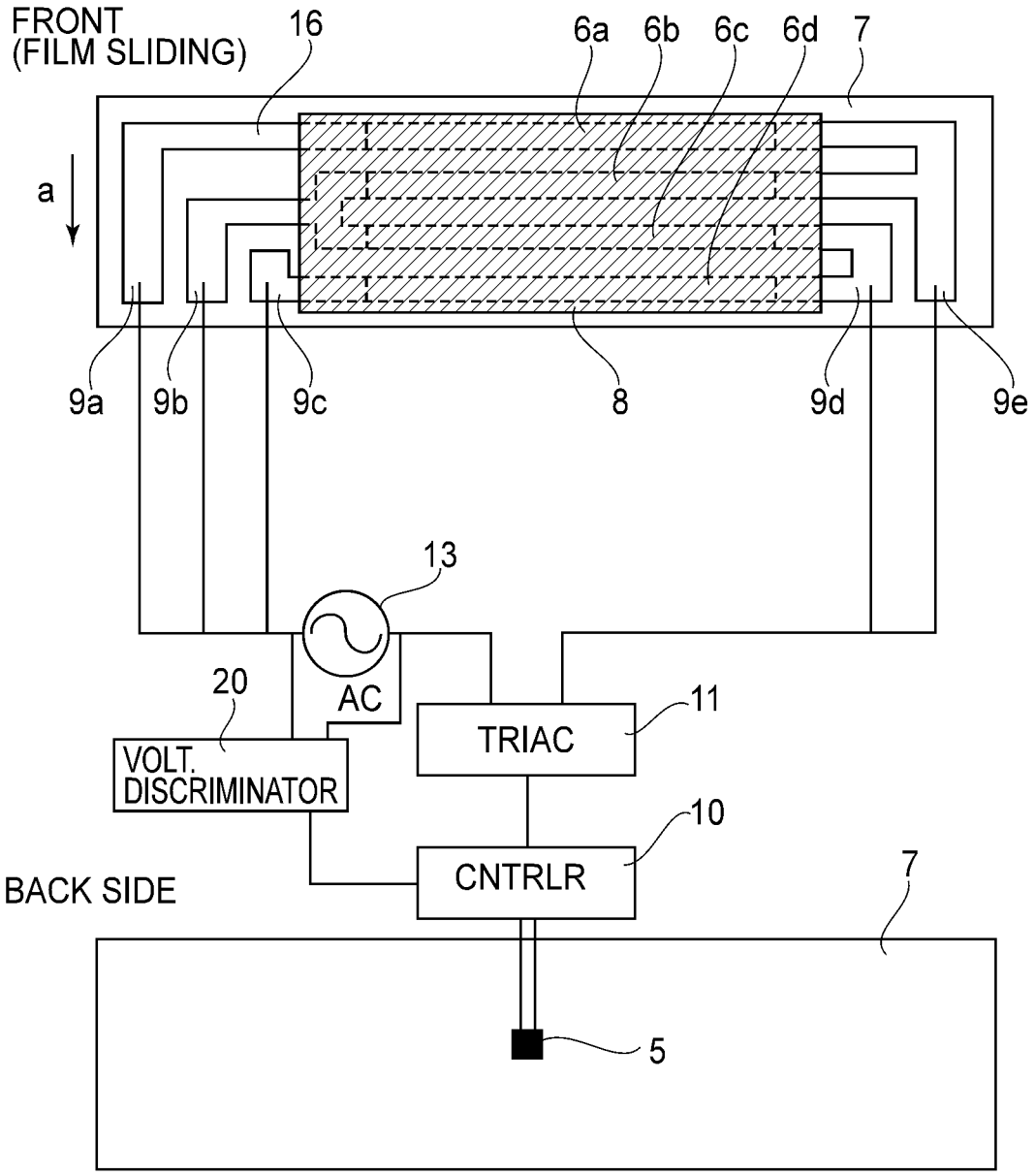
FIG. 2 is a combination of a plan view of the heater of the fixing apparatus in the first embodiment, and a current control circuit for the heater.
Figure 3:
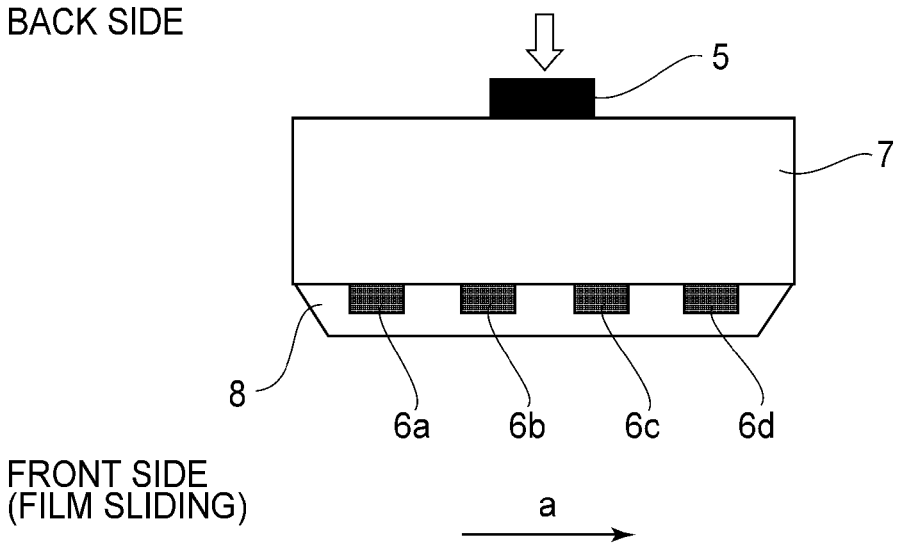
FIG. 3 is a schematic sectional view of the heater in the first embodiment, at a plane perpendicular to the lengthwise direction of the heater.
Figure 4:
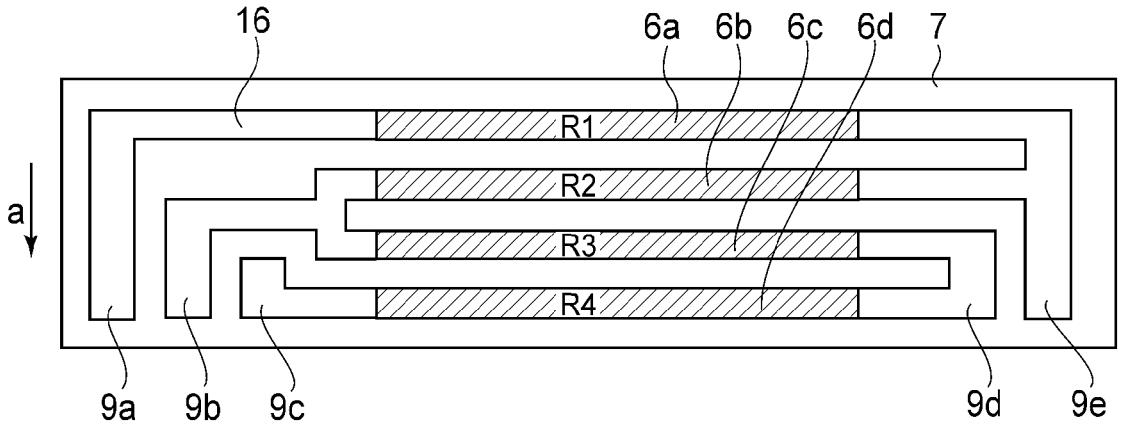
FIG. 4 is a schematic plan view of the heater minus its overcoat, in the first embodiment.
Figure 5:
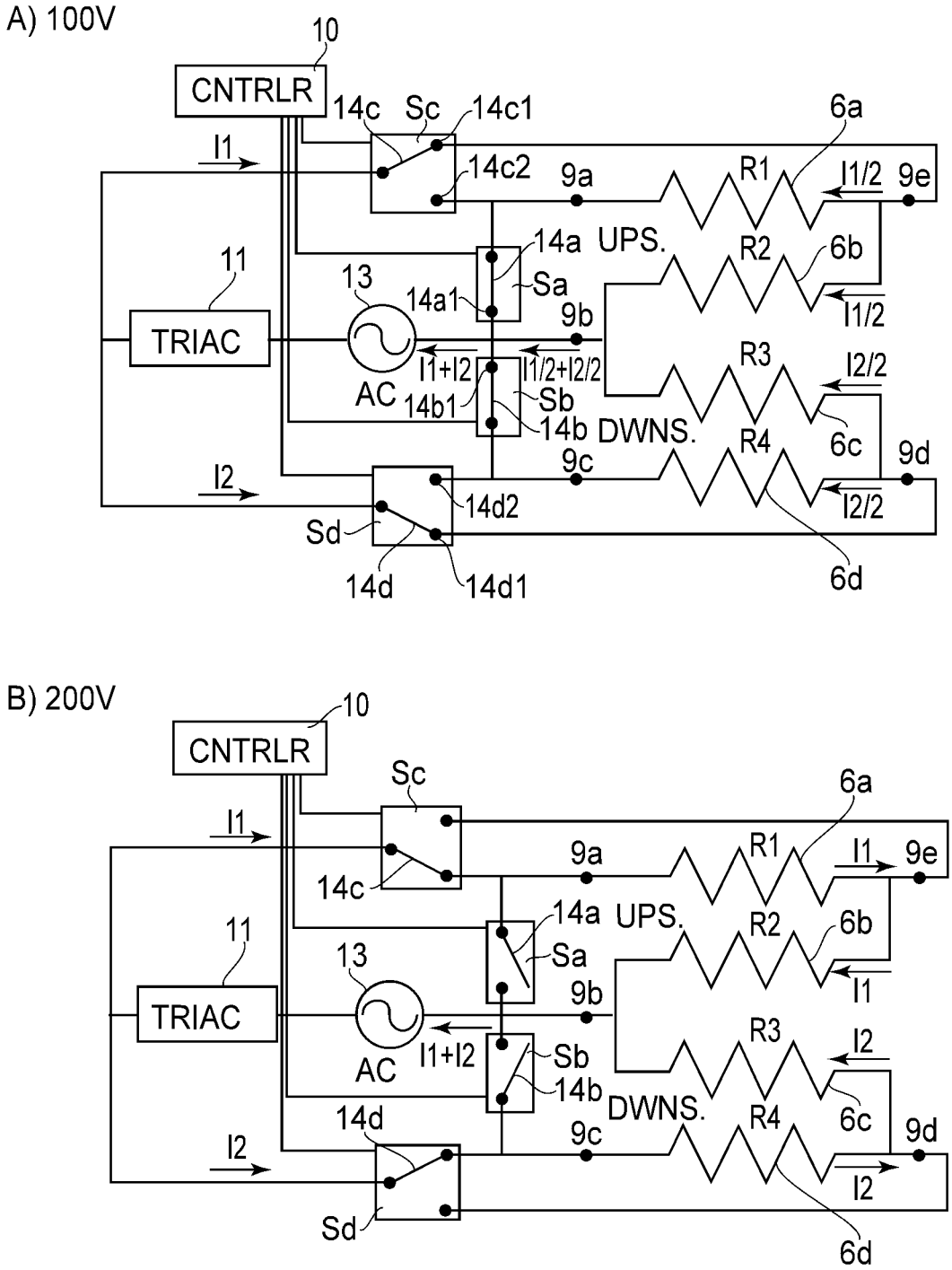
FIG. 5 is a diagram of the current control circuit of the heater in the first embodiment, and shows the current paths.

FIG. 2 is a combination of a plan view of the heater of the fixing apparatus, and a current control circuit of the heater. For the simplification, FIG. 2 shows the current control circuit, the electric power source of which is 100 V in voltage. FIG. 3 is a schematic sectional view of the heater in the first embodiment, at a plane perpendicular to the lengthwise direction of the heater. FIG. 4 is a schematic plan view of the heater minus its overcoat. FIG. 5 is a diagram of the current control circuit of the heater, and shows the current paths.

The heater 3 has a heater substrate 7 (which hereafter will be referred to simply as substrate), which is heat resistant, electrically insulative, and excellent in thermal conductivity, and the lengthwise direction of which coincides with the lengthwise direction of the fixing device 107. The heater 3 has also four heat generation resistors 6*a*, 6*b*, 6*c* and 6*d*, which are on one of the surfaces of the substrate 7, and which extend in the lengthwise direction of the substrate 7. The surface of the substrate 7, on which the heat generation resistors 6*a*, 6*b*, 6*c* and 6*d* are formed, is the surface which forms a fixation nip N (surface on which film 2 slides). The four heat generation resistors 6 are in parallel to each other in such a manner that their lengthwise direction is parallel to the lengthwise direction of the substrate 7. In this embodiment, hereafter, they will be referred to as the first, second, third, and fourth heat generation resistors 6*a*, 6*b*, 6*c* and 6*d*, respectively, listing from the upstream side in terms of the recording medium conveyance direction a.

Referring to FIG. 4, the heater 3 in this embodiment is provided with five power supplying electrodes (which hereafter will be referred to simply as electrodes) 9*a*, 9*b*, 9*c*, 9*d* and 9*e*, which are on one of the primary surfaces of the substrate 7. Among five electrodes, the electrode 9*a* is electrically in contact with heat generation resistor 6*a* through one of the patterned electrical conductors 16, and the electrode 9*b* are electrically in contact with heat generation resistors 6*b* and 6*c* through two of the patterned electrical conductors 16. The electrode 9*c* is electrically in contact with the heat generation resistor 6*d* through another of the patterned electrical conductors 16, and the electrode 9*d* is electrically in contact with the heat generation resistors 6*c* and 6*d* through two of the patterned electrical conductors 16. Further, the electrode 6*e* is electrically in contact with the heat generation resistors 6*a* and 6*b* through one of the patterned electrical conductors 16.

More specifically, the four heat generation resistors 6*a*, 6*b*, 6*c* and 6*d* are in contact with the five electrodes 9*a*, 9*b*, 9*c*, 9*d* and 9*e* in the following manner. That is, at one (left end in drawing) of the lengthwise ends of the substrate 7, the heat generation resistors 6*b* and 6*c* are in contact with a common electrode 9*b* which is at the same (left end in drawing) lengthwise end of the substrate 7 as the resistors 6*b* and 6*c*. At the other lengthwise end (right end in drawing) of the substrate 7, the heat generation resistors 6*a* and 6*b* are in contact with a common electrode 9*e* which is at the same lengthwise end (right end in drawing) as the resistors 6*a* and 6*b*, and the heat generation resistors 6*c* and 6*d* are in contact with a common electrode 9*d* which is at the same lengthwise end (right end in drawing) as the resistors 6*c* and 6*d*.

The heat generation resistors 6*a*, 6*b*, 6*c* and 6*d* on one of the primary surfaces of the substrate 7 are covered with a heat resistant overcoat 8 as a surface protection layer.

That is, the heater 3 in this embodiment has: the substrate 7; four heat generation resistors 6*a*, 6*b*, 6*c* and 6*d*; five electrodes 9*a*, 9*b*, 9*c*, 9*d* and 9*e*; patterned electrical conductors which provide electrical connection between four heat generation resistors and five electrodes; and overcoat layer 8 which protects the surface of the substrate 7, on which the heat generation resistors 6 are present. It is low in overall thermal capacity.

The four heat generation resistors 6*a*, 6*b*, 6*c* and 6*d* of the heater 3 were manufactured by placing paste concocted by mixing and kneading silver-palladium, glass powder (inorganic bonding agent), and organic bonding agent, on one of the primary surface of the substrate 7 with the use of a screen printing technology. All of the four heat generation resistors 6*a*, 6*b*, 6*c* and 6*d* in this embodiment are 1 mm in width, 222 mm in length, and roughly 10 μm in thickness. In terms of the widthwise direction, the distance between adjacent two heat generation resistors 6 among the four heat generation resistors 6*a*, 6*b*, 6*c* and 6*d*, and the distance between the substrate edge and adjacent heat generation resistor 6, are 1 mm. Hereafter, the electrical resistance values of the heat generation resistors 6*a*, 6*b*, 6*c* and 6*d* are referred to as R1, R2, R3 and R4, respectively. The electrical resistance values will be described later.

As the material for the substrate 7 which is heat resistant and electrically insulative, ceramic such as aluminum oxide, aluminum nitride, or the like is used. The substrate 7 in this embodiment is made of aluminum oxide. It is 9 mm in width, 270 mm in length, and 1 mm in thickness.

The overcoat layer 8 is for ensuring that the heat generation resistors 6*a*, 6*b*, 6*c* and 6*d* on the substrate 7 are electrically insulated, and also, for reducing the friction between the inward surface of the fixation film 2 and the heater 3. The overcoat layer 8 in this embodiment is a heat resistant glass layer which is roughly 50 μm in thickness.

The electrodes 9*a*, 9*b*, 9*c*, 9*e* and 9*d*, and patterned electrical conductors 16, were formed of silver, with the use of a screen printing pattern. They are roughly 10 μm in thickness. The electrodes 9*a*, 9*b*, 9*c*, 9*d* and 9*e* and patterned electrical conductors 16, are for supplying the heat generation resistors 6*a*, 6*b*, 6*c* and 6*d* with electric power. Therefore, they were made low enough in electrical resistance relative to the heat generation resistors 6*a*, 6*b*, 6*c* and 6*d*.

The fixing device 107 is provided with a temperature sensing element 5, as a temperature detecting member, which is on the opposite surface of the substrate 7 from the surface of the substrate 7, which forms the fixation nip N (back surface (surface which does not face film 2)). The temperature sensing element 5 in this embodiment is a thermistor, and is not directly in contact with the heater 3. This thermistor 5 of the indirect contact type is made up of a specific supporting member (unshown), an adiabatic layer, a thermistor chip, and is structured so that the adiabatic layer is on the supporting member, and also, so that the thermistor chip is attached to the adiabatic layer. It is to be attached to the bottom side (rear side) of the substrate of the heater 3 in such a manner that the thermistor chip is kept in contact with the rear surface of the substrate 7, with the provision of a preset amount of pressure between the thermistor chip and the substrate 7. In this embodiment, the material for the supporting member of the thermistor 5 is highly heat resistant liquid polymer, and the material for the adiabatic layer is laminar ceramic paper. The thermistor 5 is electrically in contact with a CPU 10 as a controlling means.

The heater 3 structured as described above is solidly attached to the downwardly facing surface of the heater holder 1 in such an attitude that the surface of the substrate 7, on which the heat generation resistors 6*a*, 6*b*, 6*c* and 6*d*, and overcoat 8 are present, faces downward. Since the heater 3 is structured as described above, it is very low in overall thermal capacity, being therefore capable of starting up very quickly.

Referring to FIG. 2, the current control circuit of the heater 3 has a control section 10 and a triac 11. The control section 10 is a controlling means made up of a CPU, and a memory such as a ROM, a RAM, and the like. The triac 11 is for controlling the electric power to be supplied to the heat generation resistors 6*a*, 6*b*, 6*c* and 6*d*. The current control circuit of the heater 3 has also a voltage discrimination circuit 20 (FIG. 2) as a means for detecting the voltage of the electrical power supplied by a commercial power source 13. It has also four relays (which hereafter will be referred to as switches) Sa, Sb, Sc and Sd (FIGS. 5A) and 5B)) as a current path switching means which switches the heat generation resistors 6*a*, 6*b*, 6*c* and 6*d* in current path.

The voltage discrimination circuit 20 is provided with a threshold value (preset voltage) for determining whether the voltage supplied by the commercial power source 13 as the main switch of the image forming apparatus (printer) is turned on is 100 V or 200 V. In this embodiment, it is assumed that a commercial power source, the rated voltage of which is 100 V, is afforded a margin of +10%. Thus, the maximum voltage of a commercial power source in Mexico, for example, is 139.7 V, since the rated voltage of the commercial power source in Mexico is 127 V. Further, it is assumed that a commercial power source, the rated voltage of which is 200, is afforded a margin of −15%. Therefore, the minimum voltage of a commercial power source, the rated voltage of which is 200, is 187 V in consideration of the margin of −15%. The aforementioned threshold value was set to 160 V, which is the middle of 139.7 V and 187 V. Further, voltage discrimination circuit 20 is provided with a subordinate electrical circuit which determines whether the electrical power source with which the fixing device 107 is in contact is a 100 V power source or a 200 V power source. That is, if the voltage level detected by the subordinate electric circuit is no higher than 160 V, the voltage discrimination circuit 20 determines that the power source with which the fixing device 107 is in connection is a 100 V power source, whereas if the voltage level detected by the subordinate electric circuit is no less than 160 V, the voltage discrimination circuit 20 determines that the power source with which the fixing device 107 is in connection is a 200 V power source.

This current control circuit of this heater 3 determines the voltage of the commercial power source 13 with the use of its voltage discrimination circuit 20, and controls the switches Sa, Sb, Sc and Sd with use of the control section 10, according to the results of the discrimination, in order to switch the heater 3 in the current paths to the heat generation resistors 6*a*, 6*b*, 6*c* and 6*d* of the heater 3. The structure of this current control circuit will be described later in detail.

(2-4) Pressure Roller 4 (Pressure Applying Member)

The pressure roller 4 has a metallic core 4*a*, an elastic layer 4*b*, a parting layer 4*c*, etc. The metallic core 4*a* is in the form of a round shaft. The elastic layer 4*b* covers the portion of the peripheral surface of the metallic core 4*a*, which is between the lengthwise end portions of the metallic core 4*a*, by which the metallic core 4*a* is supported. The parting layer 4*c*, which is the outermost layer of the pressure roller 4, covers the outward surface of the elastic layer 4*b*. In this embodiment, the metallic core 4*a* is made of aluminum, and the elastic layer 4*b* is formed of silicone rubber. The parting layer 4*c* is a piece of PFA tube which is roughly 50 μm in thickness. The pressure roller 4 is 24 mm in external diameter. The elastic layer 4*b* is 230 mm in length, and roughly 3 mm in thickness.

The fixing device 107 is structured so that the heater 3 supported by the heater holder 1 is within the film loop and the pressure roller 4 opposes the heater 3 with the presence of the film between itself and heater. Further, the lengthwise end portions of metallic core 4 are rotatably supported by the aforementioned lateral frames of the fixing device 107, with the presence of a pair of bearings (unshown) between the lateral frames and the lengthwise end portions of the pressure roller 4, one for one. Each bearing is kept pressed toward the fixation film 2 with the application of a preset amount of pressure generated by a pressure applying means (unshown) such as a compression spring, or the like.

Thus, the peripheral surface of the pressure roller 4 is kept pressed upon the outward surface of the fixation film 2 by the pressure from the above described pressure applying means. Therefore, the elastic layer 4*b* of the pressure roller 4 is kept elastically deformed across the entire range of the heater 3 in terms of the lengthwise direction of the heater 3. Thus, a fixation nip N is formed between the peripheral surface of the pressure roller 4 and the corresponding surface of the fixation film 2.

(2-5) Thermal Fixation of Toner Image T by Fixing Device 107

The pressure roller 4 of the fixing device 107 in this embodiment is rotated in the direction indicated by an arrow mark (FIG. 1) at a preset peripheral velocity (process speed)

by a motor M (FIG. 1) which is rotationally driven in response to a print command. The rotation of the pressure roller 4 is transmitted to the fixation film 2 by the friction between the peripheral surface of the pressure roller 4 and the outward surface of the fixation film 2, in the fixation nip N. That is, the fixation film 2 is circularly moved in the direction indicated by an arrow mark (FIG. 1) by the rotation of the pressure roller 4, with the inward surface of the fixation film 2 remaining in contact with the surface of the overcoat layer 8.

The control section 20 turns on the triac 11 in response to the print command. Thus, the triac 11 begins to supply the electrodes 9*a*, 9*b*, 9*c* and 9*d* of the heater 3 with electric power. As electric power is supplied to the electrodes 9*a*, 9*b*, 9*c* and 9*d* which are in connection to the heat generation resistors 6*a*, 6*b*, 6*c* and 6*d*, respectively, the heater 3 quickly increases in temperature across its entire range in terms of the lengthwise direction. This increase in the temperature of the heater 3 is detected by the thermistor 5, which outputs electrical signals, the magnitude of which is proportional to the detected temperature of the heater 3.

The electrical signals outputted by the heater 3, which are in the form of AC voltage, are converted into DC voltage by a preset A/D conversion circuit, and then, are taken in by the control section 10, which controls the heater 3 in temperature by controlling in phase, frequency, etc., the electric power to be supplied to the heat generation resistors 6*a*, 6*b*, 6*c* and 6*d* by the triac 11, based on the electrical signals outputted by the thermistor 5. More specifically, if the temperature of the heater 3 detected by the thermistor 5 is no higher than a preset level (target temperature level), which is necessary for the thermal fixation of an unfixed toner image, the control section 10 controls the power delivery to the heat generation resistors 6 so the heater 3 increases in temperature. On the other hand, if the temperature of the heater 3 detected by the thermistor 5 is no less than the preset level, the control section 10 controls the power delivery to the heat generation resistors 6 so that the heater decreases in temperature. Thus, the heater 3 remains stable at a preset level during fixation.

In this embodiment, the electrical current which flows from the electrical power source to the heat generation resistors 6 is controlled in phase by the triac 11, whereby the heater can be changed in output, in a heat generation range of 0%-100%, with an increment of 1.25%; heater output can be set to one of 81 levels in a range of 0%-100%. That the output of the heater 3 is 100% means that the AC from the power source 13 is flowed to the heat generation resistors 6*a*, 6*b*, 6*c* and 6*d*, with no modification.

While the heater 3 is kept stable in temperature at a preset level and the fixation film 2 which is being circularly moved by the rotation of the pressure roller 4 is remaining stable in speed, a sheet P of recording medium, on which an unfixed toner image T is present, is introduced into the fixation nip N, in such an attitude that the surface of the sheet P, on which the unfixed toner image is present, faces upward.

Then, this sheet P of recording medium is conveyed through the fixation nip N while remaining pinched by the surface of the fixation film 2 and the peripheral surface of the pressure roller 4. While the sheet P is conveyed through the fixation nip N, the sheet P and the unfixed toner image thereon are subjected to the pressure in the nip N and the heat transmitted thereto from the heater 3 through the fixation film 2. Thus, the unfixed toner image is thermally fixed to the sheet P. After being conveyed through the fixation nip N, the sheet P is separated from the surface of the fixation film 2, and is conveyed further.

(3) Description of Current Paths of Current Control Circuit of Heater 3

Before the current paths which are created in the current control circuit of the heater 3 in this embodiment when the rated voltage of the power source is 100 V, and those when the rated voltage of the power source is 200 V, are described, an example of a comparative heating apparatus (device) which is usable with both a 100 V power source and a 200 V power source is described.

The comparative heating apparatus (device) is almost the same in structure as the fixing device 107 in this embodiment. That is, the two heating apparatuses are different in only the heater structure and the current control circuit of the heater. Thus, the referential codes given to the heater of the comparative fixing device and the current control circuit of the heater are the same as those given to the counterparts of the fixing device in this embodiment, except for those given to the members, portions thereof, etc., of the comparative fixing device, which are different from the counterparts in this embodiment.

Figure 14:
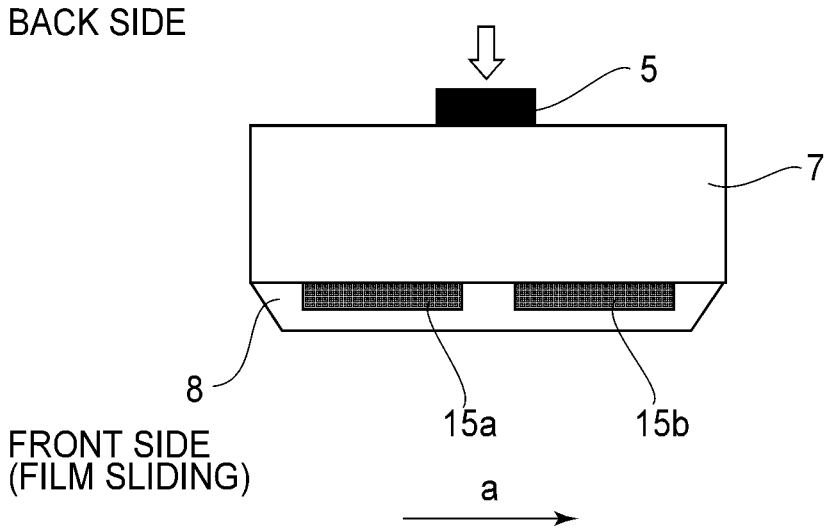
FIG. 14 is a schematic sectional view of the heater in a comparative fixing apparatus (fixing apparatus in accordance with prior art), at a plane perpendicular to the lengthwise direction of the heater.
Figure 15:
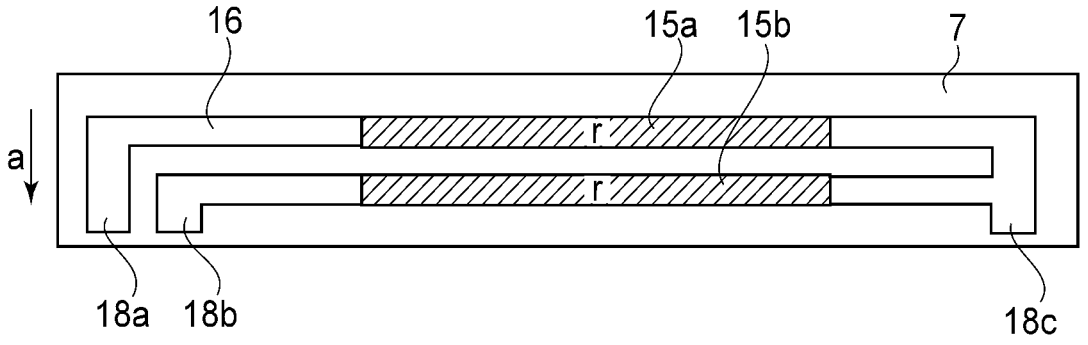
FIG. 15 is a schematic front plan view of the heater minus its overcoat, of the comparative fixing apparatus (fixing apparatus in accordance with prior art).
Figure 16:
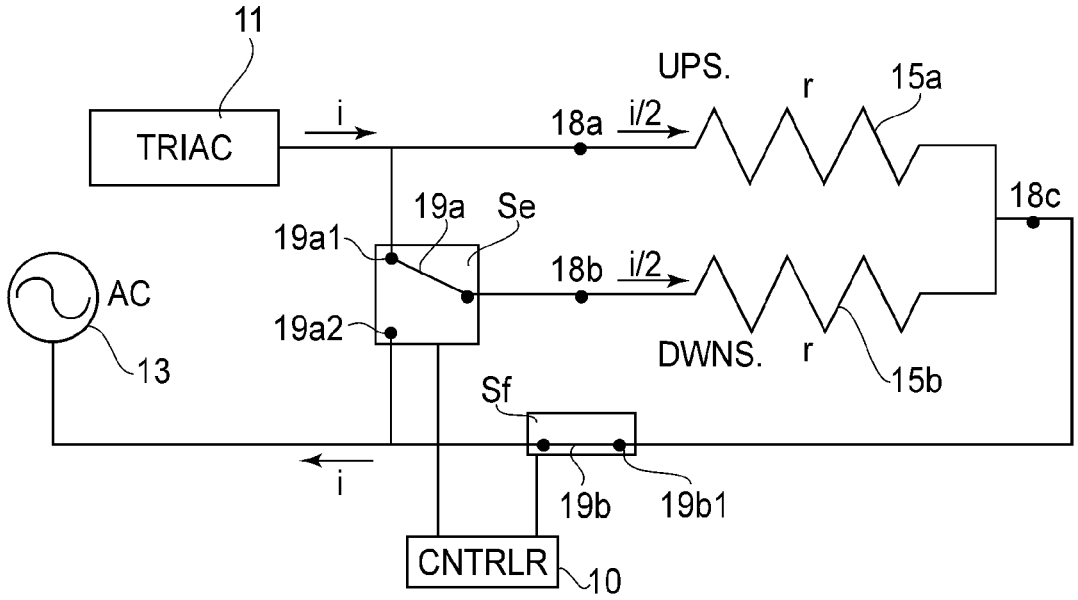
FIG. 16 is a drawing of the current control circuit of the heater of the fixing apparatus in accordance with the prior art, and shows the current paths.
Figure 16:
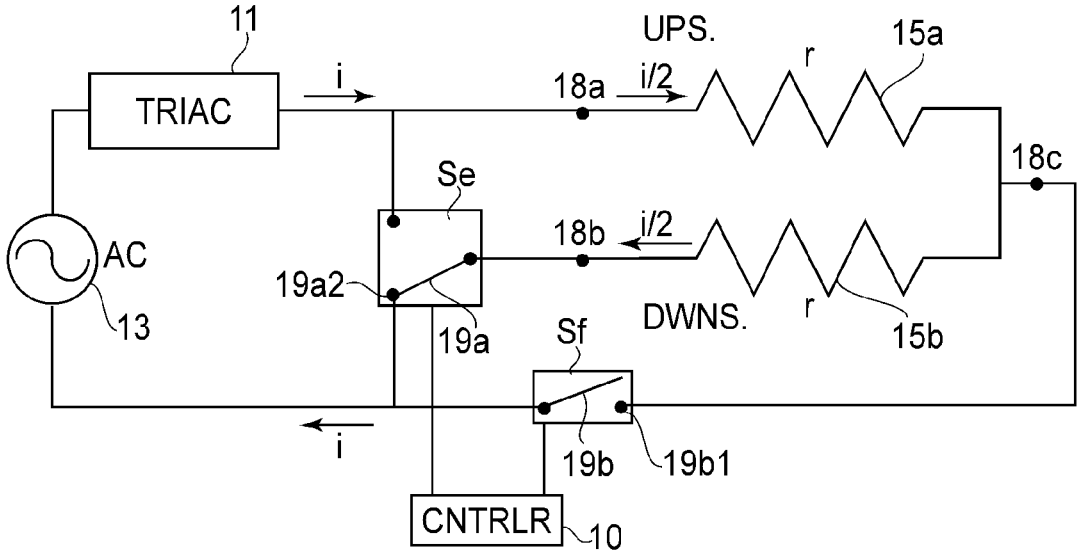

FIG. 13 is a combination of a plan view of the heater of the comparative image heating device, and a block diagram of the current control circuit for the heater. For the sake of simplification, FIG. 13 shows only the current control circuit in a case where the rated voltage of the power source 13 is 100V. FIG. 14 is a schematic sectional view of the heater of the comparative fixing apparatus, at a plane perpendicular to the lengthwise direction of the heater. FIG. 15 is a schematic plan view of the heater 3 minus its overcoat 8, of the comparative fixing apparatus. FIG. 16 is a diagram of the current control circuit for the heater 3 of the comparative fixing device, and shows the current paths of the current control circuit. FIG. 16(A) is a diagram of the current paths of the current control circuit of the comparative fixing device when the device is in connection with an electrical power source which is 100 in rated voltage. FIG. 16(B) is a diagram of the current paths of the current control circuit of the comparative fixing device when the device is in connection with an electrical power source which is 200 in rated voltage.

The heater 3 of the comparative fixing device is made up of a substrate 7 and two heat generation resistors 15*a* and 15*b*. The two heat generation resistors 15*a* and 15*b* are on the surface of the substrate 7, and are extended in parallel in the lengthwise direction of the substrate 7. The heat generation resistors 15*a* and 15*b* of the heater 3 of the comparative fixing device also were formed, on the surface of the substrate 7, of the paste concocted by mixing and kneading silver-palladium, glass powder (inorganic bonding agent), organic bonding agent, with the use of the screen printing technology. The two heat generation resistors 15*a* and 15*b* are 3 mm in width, 222 mm in length, and roughly 10 μm in thickness. In terms of the widthwise direction of the substrate 7, the distance between the two heat generation resistors 15*a* and 15*b*, and the distance between any edge of the substrate 7 and the adjacent heat generation resistor 15, are 1 mm. That is, the heat generation resistors 15*a* and 15*b* are the same in dimension as the heat generation resistors 6 of the fixing device in this embodiment, except for their width. The heat generation resistors 15*a* and 15*b* are the same in the amount of electrical resistance, which hereafter will be referred to as "r". The amount of the resistance r of the heat generation resistors 15*a* and 15*b* is 18Ω.

Referring to FIG. 15, the heater 3 of the comparative fixing device has three power supply electrodes 18*a*, 18*b* and 18*c* (which hereafter will be referred to simply electrodes), which are on the surface of the substrate 7. The electrode 18*a* is electrically in connection with the heat generation resistor 15*a* through a patterned electrically conductor 16. The electrode 18*b* is electrically in contact with the heat generation resistor 15*b* through a patterned electrical conductor 16. The electrode 18*c* is electrically in contact with the heat generation resistors 15*a* and 15*b* through a patterned electrical conductor 16. That is, the electrode 18*c*, which hereafter may be referred to common electrode) is shared by the two heat generation resistors 15*a* and 15*d*.

The substrate 7 and overcoat 8 of the heater 3 of the comparative fixing device are the same as those of the fixing device 107 in this embodiment. The electrodes 18*a*, 18*b* and 18*c* and patterned electrical conductor 16 of the heater 3 of the comparative fixing device are formed of silver-palladium by screen printing (roughly 10 μm in thickness), like the counterparts in this embodiment.

Designated by a referential code 5 is a temperature sensing element (FIG. 15), which is the same external temperature sensor (thermistor) as the one in this embodiment. The current control circuit of the heater 3 of the comparative fixing device also controls the amount by which electric power is supplied to the heat generation resistors 15*a* and 15*b*, with the use of a triac 11 and phase control, based on the result of the temperature detection by the thermistor 5.

The current control circuit of the heater 3 of the comparative fixing device (which hereafter will be referred to simply as "comparative current control circuit") has a triac 11, a voltage discrimination circuit 20, two current control relays Se and Sf (FIGS. 16(A) and 16(B)) (which hereafter will be referred to simply as "switch"), etc. The switches Se and Sf are for switching the current control circuit in the current paths to the heat generation resistors 15*a* and 15*b*. This current control circuit determines the voltage of the commercial electrical power source 13 with the use of a voltage discrimination circuit 20, and controls the switches Se and Sf with the use of the control section 10 to change the heat generation resistors 15*a* and 15*b* of the heater 3 in the current path thereto.

Of the switches Se and Sf shown in FIGS. 16(A) and 16(B), the switch Se is for connecting the heat generation resistors 15*a* and 15*b* in series or in parallel. The switch Sf is for blocking the circuit between the electrode 18*c* and commercial power source 13 as the heat generation resistors 15*a* and 15*b* are connected in series, and also, for unblocking the circuit between the electrode 18*c* and commercial power source 13 as the heat generation resistors 15*a* and 15*b* are connected in parallel.

Referring to FIG. 16(A), as the control section 10 receives signals which are outputted from the voltage discrimination circuit 20 to indicate the actual voltage of the 100 V power source, the control section 10 places the common contact 19*a* of the switch Se in contact with the contact 19*a*1 which is electrically in contact with the electrode 18*a* of the heat generation resistor 15*a*. Further, it places the movable contact 19*b* of the switch Sf in contact with the contact 19*b*1 which is electrically in contact with the electrode 18*c*. Thus, the heat generation resistors 15*a* and 15*b* become connected in parallel. Since the heat generation resistors 15*a* and 15*b* are the same in the amount of electrical resistance r, they both become i/2 in the amount of electrical current (½ of electrical current which flows through triac 11).

Further, the heat generation resistor 15*a*, which is the upstream heat generation resistor in terms of the recording medium conveyance direction a, and the heat generation resistor 15*a* which is the downstream heat generation resistor, are the same in the amount of electrical resistance. Therefore, the ratio in terms of the amount of heat generation between the upstream heat generation resistor 15*a* and downstream heat generation resistor 15*a* is 1:1 (which hereafter will be referred to as heat generation ratio). In the case of the comparative fixing device, r=18Ω. Thus, the overall amount of electrical resistance of the combination of the heat generation resistors 15*a* and 15 is 9Ω when the image forming apparatus is in connection to a 100 V power source.

Next, referring to FIG. 16(B), as the control section 10 receives signals which are outputted from the voltage discrimination circuit 20 to indicate the actual voltage of the 200 V power source, the control section 10 places the common contact 19*a* of the switch Se with the contact 19*a*2 which is electrically in contact with the electrode 18*c* through the switch Se. Further, it separates the movable contact 19*b* of the switch Sf from the contact 19*b*1. Thus, the heat generation resistors 15*a* and 15*b* become connected in series. Since the heat generation resistors 15*a* and 15*b* are the same in the amount of electrical resistance r, they both become i in the amount of electrical current. Further, the upstream heat generation resistor 15*a*, and the downstream heat generation resistor 15*a* are the same in the amount of electrical resistance r when the image forming apparatus is in connection to a 200 V power source. Therefore, the ratio in terms of the amount of heat generation between the upstream heat generation resistor 15*a* and downstream heat generation resistor 15*a* is 1:1 (which hereafter may be referred to simply as heat generation ratio). In the case of the comparative fixing device, r=18Ω. Thus, the overall amount of electrical resistance of the combination of the heat generation resistors 15*a* and 15 is 36Ω when the image forming apparatus is in connection to a 200 V power source.

Because the comparative heater 3 is structured as described above, the ratio in terms of the overall resistance of combination of the heat generation resistors 15*a* and 15*b* between when the image forming apparatus is in connection with a 100 V power source and when the image forming apparatus is in connection with a 200 V power source is 1:4. Table 1 shows the amount of power consumption of the heater 3 when the image forming apparatus is in connection with a 100 V power source, and that when the image forming apparatus is in connection with a 200 V power source (when output is 100%). The 100 V power sources were 100 V, 110 V, 120 V and 127 V in rated voltage. That is, when the heater output was 100%, the power consumption by the 100 V power sources falls in a range 1111 W-1792 W. The 200 V power sources were 220 V and 240 V in rated voltage. Thus, when the heater output was 100%, the power consumption by the 200 V power sources falls in a range of 1344 W-1600 W.

TABLE 1

| | | | | | |
|---|---|---|---|---|---|
| 100 V | Voltage (V) | 100 | 110 | 120 | 127 |
| | Consumption (W) | 1111 | 1334 | 1600 | 1792 |
| 200 V | Voltage (V) | — | 220 | 240 | — |
| | Consumption(W) | — | 1334 | 1600 | — |

By setting to 1:4 the ratio in terms of the overall electrical resistance of the combination of the heat generation resistors 15*a* and 15*b* between when the image forming apparatus is in connection with a power source belonging to 100 V group and when the image forming apparatus is in connection with a power source belonging to 200 V group, the amount by which the heater 3 consumes electric power when the image forming apparatus is in connection with a power source belonging to the 200 V group and the heater output is 100%, can be kept within the power consumption range of the heater 3 when the image forming apparatus is in connection with a power source belonging to a 100 V group (amount of power consumption by heater when power source voltage is 110 V is the same as that when power source voltage is 220, and amount of power consumption by heater when power source voltage is 120 is the same as that when power source voltage is 240). Thus, by setting in the amount of electrical resistance the heat generation resistors 15*a* and 15*b* so that it is ensured that they can generate heat by the amount necessary to quickly start up the heater 3 in temperature (to fixation level) when the image forming apparatus is in connection with a power source belonging to a 100 V group, and also, so that they can maintain the heater temperature at the fixation level to satisfactorily fix an unfixed toner image, the heating device can be used with no problems even when the image forming apparatus is in connection with a power source belonging to a 200 V group.

For example, in a case where the power source voltage is 120 V, and the amount of electrical power necessary to keep the heater temperature at the fixation level is 800 W, the amount by which electrical current is flowed through the heater 3 is automatically reduced to roughly 50%. Further, if the power source voltage is changed to 220 V, and the other condition is kept the same, the amount by which electrical current is flowed through the heater 3 is automatically reduced to roughly 60%, because the amount of electrical power necessary to keep the heater temperature at the fixation level is the same, that is, 800 W.

By adopting the structural arrangement for the comparative fixing device described above, it is possible to realize a heating apparatus (device) which can be used regardless of whether the power source belongs to the 100 V group or 200 V group.

Next, the current control circuit of the heater 3 in this embodiment is described in detail. FIG. 5 is a drawing for describing the current paths of the current control circuit of the heater 3 in this embodiment. More specifically, FIG. 5(A) is a diagram of the current control circuit of the heater 3, which shows the current paths created when the image forming apparatus is in connection with a power source which belongs to a 100 V group, and FIG. 5(B) is a diagram of the current control circuit, which shows the current paths created when the image forming apparatus is in connection with a power source which belongs to a 200 V group.

The current control circuit in this embodiment has two current paths between the triac 11 and heat generation resistors. Referring to FIG. 5, the top current path is in connection with the two heat generation resistors 6*a* and 6*b*, that is, the upstream heat generation resistors in terms of the recording medium conveyance direction a, and the bottom current path is in connection with the two heat generation resistors 6*c* and 6*d*, that is, the downstream heat generation resistors. Here, the current which flows through the top current path is referred to as I1, and the current which flows through the bottom path is referred to as I2.

In this embodiment, the electrical resistance values R1, R2, R3 and R4 of the heat generation resistors 6*a*, 6*b*, 6*c* and 6*d*, respectively, are set so that R1=R2=30Ω; R3=R4=45Ω; and R1<R3.

Referring to FIGS. 5(A) and 5(B), a switch Sc is for connecting the heat generation resistors 6*a* and 6*b* in series or in parallel. A switch Sd is for connecting the heat generation resistors 6*c* and 6*d* in series or in parallel. A switch Sa is for keeping connected the circuit between the electrode 9*a* and the commercial power source 13, when the heat generation resistors 6*a* and 6*b* are in connection in parallel, and also, for keeping blocked the circuit between the electrode 9*a* and commercial power source 13*a* when the heat generation resistors 6*a* and 6*b* are in connection in series. A switch Sb is for keeping connected the circuit between the electrode 9*c* and commercial power source 13 when the heat generation resistors 6*c* and 6*d* are in connection in parallel, and also, for keeping blocked the circuit between the electrode 9*c* and commercial power source 13 when the heat generation resistors 6*c* and 6*d* are in connection in series.

Referring to FIG. 5(A), as the control section 10 receives signals which are outputted from the voltage discrimination circuit 20 to indicate that the image forming apparatus is in connection with a power source which belongs to a 100 V category, it places the common contact 14*c* of the switch Sc in contact with the contacts 14*c*1 which is electrically in contact with the electrode 9*c*. Further, it places a common contact 14*d* of the switch Sd in contact with the contact 14*d*1 which is electrically in contact with the electrode 9*d*. Further, it places the movable contact 14*a* of the switch Sa in contact with the contact 14*a*1 which is electrically in contact with the electrode 9*b*. Further, it places the movable contact 14*b* of the switch Sb in contact with the contact 14*b*1 which is electrically in contact with the electrode 9*b*. Thus, the heat generation resistors 6*a* and 6*b* are connected in parallel, and so are the heat generation resistors 6*c* and 6*d*.

Further, the combination of the heat generation resistors 6*a* and 6*b*, that is, the upstream pair of heat generation resistors in terms of the recording medium conveyance direction a, and the combination of the heat generation resistors 6*c* and 6*d*, that is, the downstream pair of heat generation resistors, are connected in parallel. Consequently, all four heat generation resistors 6*a*, 6*b*, 6*c* and 6*d* become connected in parallel. Thus, the overall amount of electrical resistance of the combination of the upstream two heat generation resistors 6*a* and 6*b* becomes 15Ω, and the overall amount of electrical resistance of the combination of the downstream two heat generation resistors 6*c* and 6*d* becomes 22.5Ω. Further, the overall amount of electrical resistance of the combination of the four heat generation resistors 6*a*, 6*b*, 6*c* and 6*d* becomes 9Ω.

As described above, when the power source voltage is 100 V, the first and second heat generation resistors among the four heat generation resistors are connected in parallel, and the third and fourth heat generation resistors are connected in parallel. Further, the combination of the first and second heat generation resistors, and the combination of the third and fourth heat generation resistors, are connected in parallel. Hereafter, this state of connection among the four heat generation resistors will be referred to as the first state of connection.

Since R1=R2, both the amount of the current which flows through the heat generation resistor 6*a*, and that through the heat generation resistor 6*b* become I1/2. Similarly, both the amount of the current which flows through the heat generation resistor 6*c*, and that through the heat generation resistor 6*d* become I2/2.

Supposing here that the combination of the heat generation resistors 6*a* and 6*b* is a single upstream heat generation resistor, and also, that the combination of the heat generation resistors 6*c* and 6*d* is a single downstream heat generation resistor, the ratio in terms of the amount of electrical resistance between the upstream heat generation resistor (combination of heat generation resistors 6*a* and 6*b*) and the downstream heat generation resistor (combination of heat generation resistors 6*c* and 6*d*) is: R1/2:R3/2=1:1.5. Since the upstream heat generation resistor (combination of heat generation resistors 6*a* and 6*b*) and downstream heat generation resistor (combination of heat generation resistors 6*c* and 6*d*) are connected in parallel, the ratio in the amount of heat generation between the upstream and downstream heat generation resistors becomes 1.5:1.

Referring to FIG. 5(B), as the control section 10 receives signals which are outputted from the voltage discrimination circuit 20 to indicate that the image forming apparatus is in connection with a power source which belongs to a 200 V category, it places the common contact 14*c* of the switch Sc in contact with the contacts 14*c*2 which is electrically in contact with the electrode 9*a*. Further, it places the common contact 14*d* of the switch Sd in contact with the contact 14*d*2 which is electrically in contact with the electrode 9*c*. Further, it separates the movable contact 14*a* of the switch Sa from the contact 14*a*1. Further, it separates the movable contact 14*b* of the switch Sb from the contact 14*b*1. Consequently, the heat generation resistors 6*a* and 6*b* become connected in series, and so are the heat generation resistors 6*c* and 6*d*. Further, the combination of the upstream two heat generation resistors 6*a* and 6*b*, and the combination of the downstream heat generation resistors 6*c* and 6*d*, become connected in parallel as they are when the power source belongs to the 100 V category.

As described above, when the power source voltage is 200 V, the first and second heat generation resistors among the four heat generation resistors are connected in series, and the third and fourth heat generation resistors are connected in series. Further, the combination of the first and second heat generation resistors, and the combination of the third and fourth heat generation resistors, are connected in parallel. This state of connection among the four heat generation resistors will be referred to as the second state of connection.

When the image forming apparatus is in connection with a power source in the 200 V category, the overall amount of electrical resistance of the combination of the upstream two heat generation resistors 6*a* and 6*b* is 60Ω, and the overall amount of electrical resistance of the combination of the downstream two heat generation resistors 6*c* and 6*d* is 90Ω. Further, the overall amount of electrical resistance of the combination of the four heat generation resistors 6*a*, 6*b*, 6*c*, and 6*d* is 36Ω.

When the image forming apparatus is in connection with a power source in the 200 V category, both the amount of current which flows through the heat generation resistor 6*a*, and that through the heat generation resistor 6*b*, are I1, and both the amount of current which flows through the heat generation resistor 6*c* and that through the heat generation resistor 6*d*, are I2.

Supposing here that the combination of the heat generation resistors 6*a* and 6*b* is a single upstream heat generation resistor, and also, that the combination of the heat generation resistors 6*c* and 6*d* is a single downstream heat generation resistor, the ratio in terms of the amount of electrical resistance between the upstream heat generation resistor (combination of heat generation resistors 6*a* and 6*b*) and the downstream heat generation resistor (combination of heat generation resistors 6*c* and 6*d*) is 1:1.5. Since the upstream heat generation resistor (combination of heat generation resistors 6*a* and 6*b*) and downstream heat generation resistor (combination of heat generation resistors 6*c* and 6*d*) are connected in parallel, the ratio in the amount of heat generation between the upstream and downstream heat generation resistors becomes 1.5:1.

As described above, the overall amount of electrical resistance of the combination of the heat generation resistors 6*a*, 6*b*, 6*c* and 6*d* of the heater 3 in this embodiment is the same as the overall amount of electrical resistance of the combination of the heat generation resistors 15*a* and 15*b* of the heater 3 of the comparative fixing device regardless of whether the image forming apparatus is in connection with a power source in the 100 V category or 200 V category.

Since the heater 3 in this embodiment is structured as described above, the ratio in terms of the overall amount of electrical resistance of the combination of heat generation resistors 6*a*, 6*b*, 6*c* and 6*d* between when the image forming apparatus is in connection with a power source in the 100 V category, and when the image forming apparatus is in connection with a power source in the 200 V category is 1:4. Thus, by setting the amount of electrical resistance of the heat generation resistors 15*a* and 15*b* so that it is ensured that they can generate heat by the amount necessary to quickly start up the heater 3 in temperature (to fixation level) when the image forming apparatus is in connection with a power source in the 100 V category, and also, that they can maintain the heater temperature at the fixation level to satisfactorily fix an unfixed toner image, the heating device in this embodiment can be used with no problems, like the comparative heating device, even when the image forming apparatus is in connection with a power source belonging to the 200 V category. That is, by adopting the structural arrangement for the heater 3 in this embodiment, it is possible to realize a heating apparatus (device), like the comparative heating device, which can be used regardless of whether the power source is in the 100 V category or 200 V category.

The difference between the heater 3 in this embodiment and the comparative heater 3 is in the ratio in the amount of heat generation between the combination of the upstream heat generation resistors and the combination of the downstream heat generation resistors. In the case of the comparative heater 3, the ratio is 1:1, whereas in the case of the heater 3 in this embodiment, it is 1.5:1 (ratio remains the same regardless of structure and power source voltage (100 V or 200 V).

Figure 6:
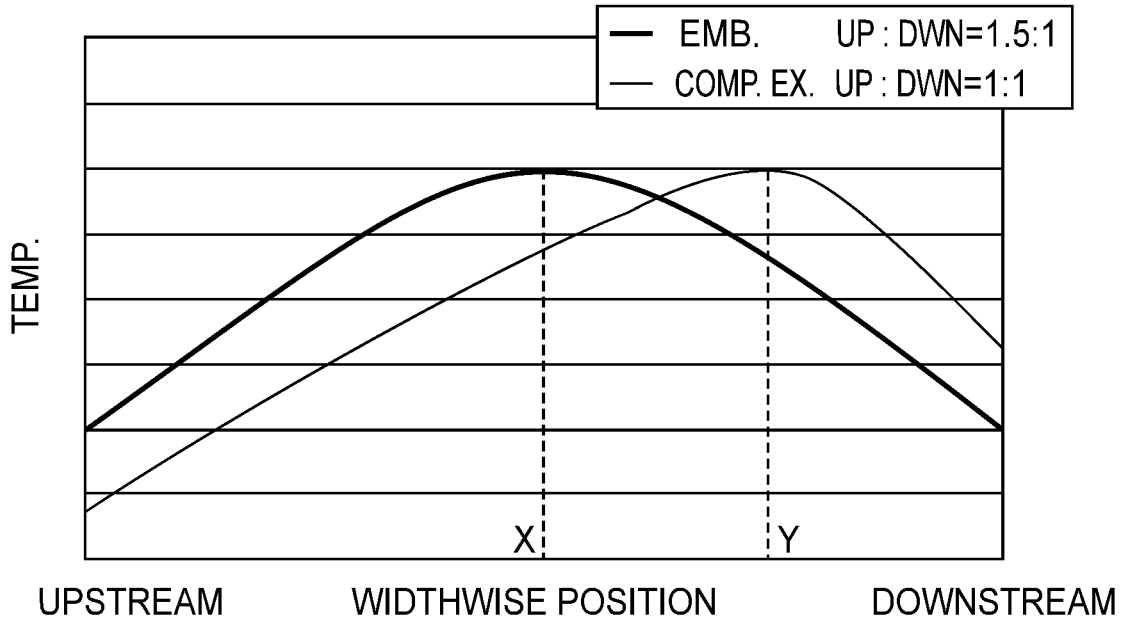
FIG. 6 is a graph which shows the temperature distribution of the heater in the first embodiment, in terms of the widthwise direction of the heater.

FIG. 6 is a graph which shows the temperature distribution of the heater in this embodiment, and that of the comparative heater, in terms of the widthwise direction of the heater (recording medium conveyance direction a). The axis of abscissa of the graph stands for a point of the heater in terms of the widthwise direction. The left end of the graph corresponds to the upstream edge of the fixation nip N in terms of the recording medium conveyance direction a, and the right end of the graph corresponds to the downstream edge of the fixation nip N in terms of the recoding medium conveyance direction a. The axis of ordinate of the graph indicates the surface temperature of the heater. The bold line stands for the temperature distribution of the fixation nip N in this embodiment, and the fine line stands for the temperature distribution of the fixation nip N of the comparative fixing device.

In the case of the comparative heater 3, the ratio in heat generation between the upstream and downstream heat generation resistors is 1:1. In terms of the recording medium conveyance direction a, the point Y in the fixation nip N, where the temperature is highest, is on the downstream side of the center of the fixation nip N, because of the effect of the circular movement of the fixation film and the rotation of the pressure roller.

In comparison, in the case of the heater 3 in this embodiment, the ratio in the amount of heat generation between the upstream and downstream heat generation resistors was 1.5:1. Thus, the point X in the fixation nip N, at which temperature is highest, is roughly the center of the fixation nip N. Therefore, the heater 3 in this embodiment can more efficiently heat a sheet P of recording medium than the comparative heater 3. That is, the former is better in fixation efficiency than the latter. When the heater 3 in this embodiment was actually compared with the comparative heater 3 in fixation efficiency while keeping the two heaters 3 roughly the same in the amount of power consumption by controlling the two heaters 3 in temperature, the heater 3 in this embodiment was superior in fixation efficiency to the conventional heater 3.

The conventional fixing device is structured so that when the image forming apparatus to which it belongs is in connection with a power source in the 100 V category, the heat generation resistors 15*a* and 15*b* of its heater 3 are connected in series. Thus, in order to make the same the temperature distribution in terms of the widthwise direction of the heater 3 when the image forming apparatus is in connection with a power source in the 100 V category, and that when the image forming apparatus is in connection with a power source in the 200 V category, the two heat generation resistors 15*a* and 15*b* have to be made the same in the amount of electrical resistance. Assuming here that the ratio in the amount of electrical resistance between the upstream and downstream heat generation resistors 15*a* and 15*b*, respectively, is made to 1:1.5, the ratio in the amount of heat generation between the upstream and downstream heat generation resistors when the image forming apparatus is in connection with a power source which is 100 V in voltage becomes 1.5:1, which is excellent from the standpoint of fixation efficiency. However, the ratio in the amount of heat generation between the upstream and downstream heat generation resistors when the image forming apparatus is in connection with a power source which is 200 V in voltage becomes 1:1.5, which makes the fixing device lower in fixation efficiency.

That is, in the case of the comparative heater 3, it is mandatory that the ratio in the amount of heat generation between the upstream and downstream heat generation resistors is made to be 1:1. In comparison, the heater 3 in this embodiment can make the ratio in the amount of heat generation between the upstream and downstream heat generation resistors such that the upstream heat generation resistor is greater in the amount of heat generation than the downstream one. Thus, the heater 3 in this embodiment is superior to the comparative heater 3 from the standpoint of fixation efficiency.

As described above, the heater 3 in this embodiment can make the ratio in the amount of heat generation between the combination of the upstream heat generation resistors 6*a* and 6*b* and the combination of the downstream heat generation resistors 6*c* and 6*d* 1.5:1. Therefore, it can keep the position X of the peak of the temperature distribution in the fixation nip in terms of the widthwise direction of the fixation nip at roughly the widthwise center of the fixation nip N. Therefore, the fixing device 107 which employs the heater 3 in this embodiment is superior to any fixing device in accordance with the prior art, in terms of the efficiency (heating efficiency) with which an unfixed toner image T on a sheet P of recording medium can be fixed, regardless of whether the power source with which the image forming apparatus is in connection belongs to a 100 V category or a 200 V category.

Incidentally, the distance (distance between X and Y in FIG. 6) by which the point in the fixation nip N, which is highest in temperature in terms of the recording medium conveyance direction, deviates in the widthwise direction of the fixation nip from the widthwise center of the fixation nip when the upstream and downstream heat generation resistors are the same in the amount of heat generation, is affected by the fixing device structure, recording medium conveyance speed, and/or etc. Therefore, the optimum ratio in the amount of heat generation between the upstream and downstream heat generation resistors is not always 1.5:1. For example, in a case where the heater 3 in this embodiment is to be installed in a fixing device different from the one in this embodiment, the ratio in the amount of heat generation between the upstream and downstream heat generation resistors has only to be set to be optimal according to the specification of this fixing device by changing the ratio between the amount of electrical resistance R1 of the heat generation resistor 6*a* and the amount of electrical resistance R3 of the heat generation resistor 6*c*.

Embodiment 2

Figure 7:
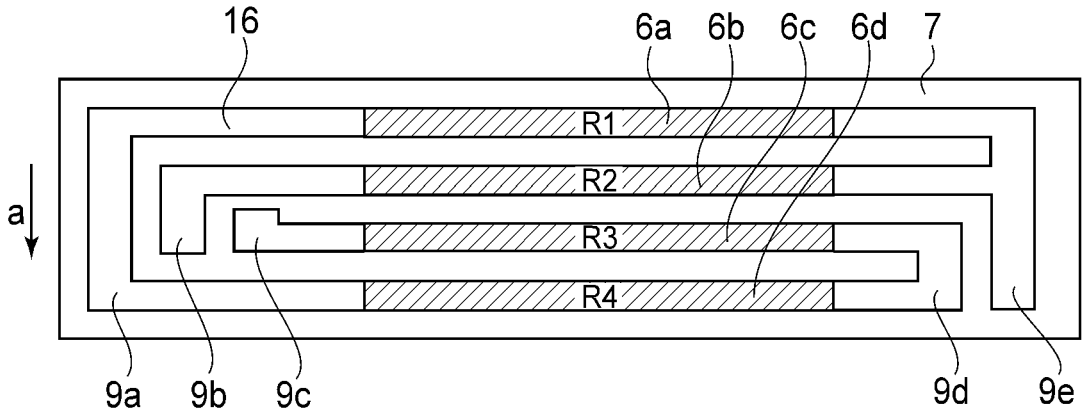
FIG. 7 is a schematic plan view of the heater minus its overcoat, in the second embodiment of the present invention.

Next, another example of the heater in accordance with the present invention is described. FIG. 7 is a schematic plan view of the heater minus its over coat, in this embodiment of the present invention.

The difference between the heater 3 in this embodiment and the heater 3 in the first embodiment is in the shape of the electrodes 9*a*, 9*b* and 9*c*, which are on one of the lengthwise end portions of the substrate 7. In the case of the heater 3 in the first embodiment, the electrode 9*a* is in connection with the heat generation resistor 6*a* through a patterned electrical conductor 16, and electrode 9*b* is in connection with the heat generation resistors 6*b* and 6*c* through another patterned electrical conductor 16. Further, the electrode 9*c* is electrically in connection with the heat generation resistor 6*d* through another patterned electrically conductor 16. In comparison, in the case of the heater 3 in this embodiment, the electrode 9*a* is in connection with the heat generation resistors 6*a* and 6*d* through a patterned electrically conductor 16, and the electrode 9*b* is in connection with the heat generation resistor 6*b* through another patterned electrically conductor 16. Further, the electrode 9*c* is in connection with the heat generation resistor 6*c* through another portion of the patterned electrical conductor 16.

The four heat generation resistors 6*a*, 6*b*, 6*c* and 6*d* and five electrode 9*a*, 9*b*, 9*c*, 9*d* and 9*e* are connected as follows. On one of the lengthwise end portions of the substrate 7, the heat generation resistors 6*a* and 6*d* are in connection with the common electrode 9*a* which is on the substrate 7. On the other lengthwise end portion of the substrate 7, the heat generation resistors 6*a* and 6*b* are in connection with the common electrode 9*c* which is on the substrate 7. Further, the heat generation resistors 6*c* and 6*d* are in connection with the common electrode 9*d* on the substrate 7.

Figure 8:
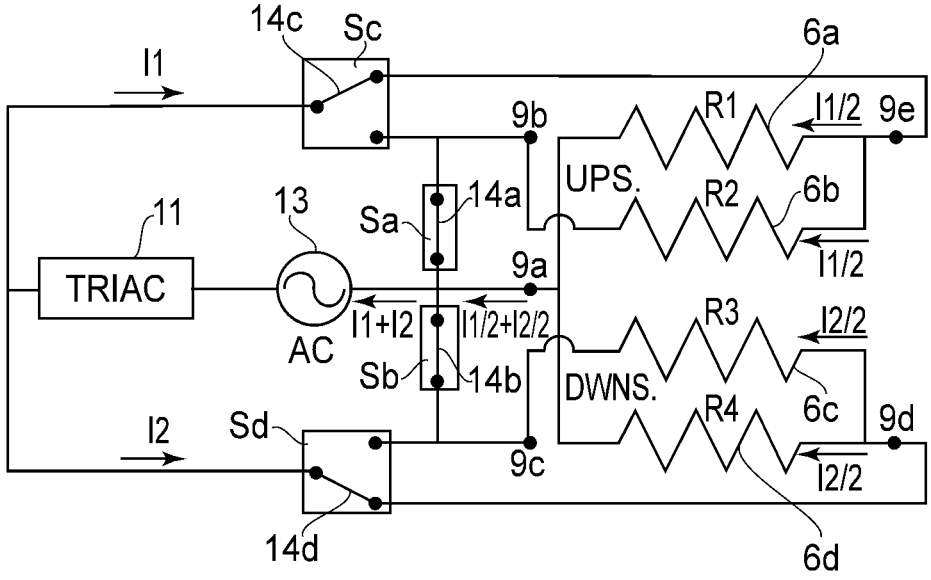
FIG. 8 is a diagram of the current control circuit of the heater in the second embodiment, and shows the current paths.
Figure 8:
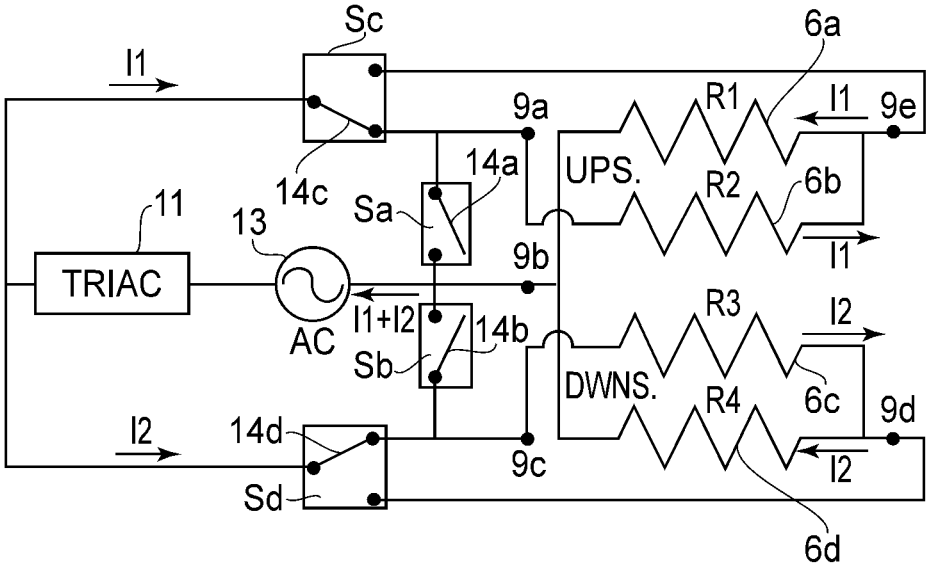

FIG. 8 is a diagram for showing the current paths of the current control circuit of the heater 3 in the second embodiment. More specifically, FIG. 8(A) is a diagram for showing the current paths of the current control circuit, through which current is flowed when the power source voltage is 100 V. FIG. 8(B) is a diagram for showing the current paths of the current control circuit, through which current is flowed when the power source voltage is 200 V. The current control circuit shown in FIG. 8 is electrically equivalent to the current control circuit of the heater 3 in the first embodiment, which is shown in FIG. 5.

When the power source voltage is in 100 V category, the control section 10 in this embodiment places the common contact 14*c* of the switch Sc in contact with the contact 14*c*1 which is electrically in contact with the electrode 9*e*. Further, it places the common contact 14*d* of the switch Sd in contact with the contact 14*d*1 which is electrically in contact with the electrode 9*d*. Further, it places the movable contact 14*a* of the switch Sa in contact with the contact 14*a*1 which is electrically in contact with the electrode 9*a*. Moreover, it places the movable contact 14*b* of the switch Sb in contact with the contact 14*b*1 which is electrically in contact with the electrode 9*a*. Thus, the heat generation resistors 6*a* and 6*b* are connected in parallel, and so are the heat generation resistors 6*c* and 6*d*.

When the power source is in the 200 V category, the control section 10 in this embodiment places the common contact 14*c* of the switch Sc in contact with the contact 14*c*2 which is electrically in contact with the electrode 9*a*. Further, it places the common contact 14*d* of the switch Sd in contact with the contact 14*d*2 which is electrically in contact with the electrode 9*c*. Further, it separates the movable contact 14*a* of the switch Sa from the contact 14*a*1. Further, it separates the movable contact 14*b* of the switch Sb from the contact 14*b*1. Thus, the heat generation resistors 6*a* and 6*b* become connected in series, and the heat generation resistors 6*c* and 6*d* become connected in series. Moreover, the combination of the upstream two heat generation resistors 6*a* and 6*b* and the combination of the downstream two heat generation resistors 6*c* and 6*d* become connected in parallel as they are when the power source is in the 100 V category.

That is, also in the case of the heater 3 in this embodiment, it is possible to make the ratio in the amount of heat generation between the upstream and downstream heat generation resistors 1.5:1 as in the case of the heater 3 in the first embodiment. Thus, it is possible to keep the peak of the temperature distribution of the fixation nip N in terms of the widthwise direction of the nip, roughly at the widthwise center of the fixation nip N. In other words, the fixing device 107 which employs the heater 3 in this embodiment can provide the same operational effects as the fixing device 107 which employs the heater 3 in the first embodiment.

Also in the case of the heater 3 in this embodiment, the ratio in the amount of heat generation between the upstream and downstream heat generation resistors has only to be set to be optimal by changing the ratio between the amount of the electrical resistance R1 of the heat generation resistor 6*a* and the amount of electrical resistance R3 of the heat generation resistor 6*b*, according to the specifications of the fixing device by which the heater 3 is employed.

Embodiment 3

Figure 9:
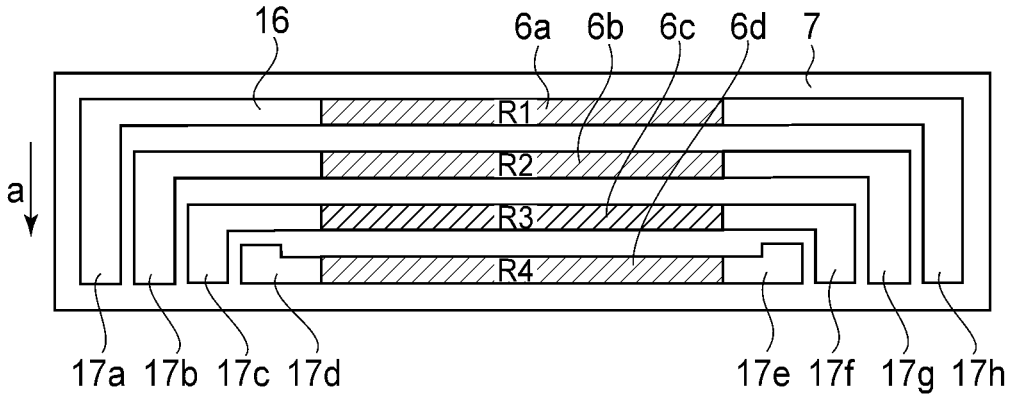
FIG. 9 is a schematic plan view of the heater minus its overcoat, in the third embodiment of the present invention.

Next, another embodiment of the present invention is described. FIG. 9 is a plan view of the heater 3 in this embodiment minus its overcoat.

In the first and second embodiments, the number of the electrodes was limited to five in order to simplify the heater 3 in structure. In this embodiment, however, the heater 3 are provided with four heat generation resistors 6*a*, 6*b*, 6*c* and 6*d*, and eight electrodes 17*a*, 17*b*, 17*c*, 17*d*, 17*e*, 17*f*, 17*g* and 17*h*. The eight electrodes 17 are independent from each other. The electrodes 17*a*, 17*b*, 17*c* and 17*d* are on one of the lengthwise end portions of the substrate 7, and the electrodes 17*e*, 17*f*, 17*g* and 17*h* are on the other lengthwise end portion of the substrate 7, with the presence of patterned electrical conductors 16 between the electrodes and heat generation resistors 6. Further, the heater 3 is provided with common electrodes (unshown) which are placed in the current paths between electrodes and the aforementioned switches (unshown), one for one. Thus, the heater 3 in this embodiment is equivalent to the heater in the first embodiment and the heater 3 in the second embodiment, in terms of current path.

The method for making the current paths of the heater 3 in this embodiment equivalent to those of the heater 3 in the first embodiment is as follows: That is, on one of the lengthwise end portions of the substrate 7, the heat generation resistors 6*b* and 6*c* are placed in contact with a common electrode (unshown), whereas on the other lengthwise end portion of the substrate 7, the heat generation resistors 6*a* and 6*b* are placed in contact with a common electrode (unshown), and the heat generation resistors 6*c* and 6*d* are connected to another common electrode (unshown).

The method for making the current paths of the heater 3 in this embodiment equivalent to those of the heater 3 in the first embodiment is as follow. That is, on one the lengthwise end portions of the substrate 7, the heat generation resistors 6*a* and 6*d* are connected to a common electrode (unshown), whereas on the other lengthwise end portion of the substrate 7, the heat generation resistors 6*a* and 6*b* are connected to a common electrode (unshown). Further, the heat generation resistors 6*c* and 6*d* are connected to a common electrode (unshown).

Also in the case of the heater 3 in this embodiment, it is possible to make the ratio in the amount of heat generation between the upstream and downstream heat generation resistors 1.5:1, in order to keep the peak of the temperature distribution of the fixation nip N in terms of the widthwise direction of the fixation nip N, roughly at the widthwise center of the nip N as in the case of the heater 3 in the first embodiment. Thus, the same operational effects as those obtainable by the fixing device 107 in the first embodiment can also be obtained by the fixing device 107 which employs the heater 3 in this embodiment.

Compared to the heater 3 in this embodiment which has eight electrodes, the heaters 3 in the first and second embodiments are only five in the number of electrodes. That is, not only are the heaters in the first and second embodiments simpler in the current paths, but also, smaller in the number of contacts between the electrodes and current paths. Therefore, the heaters 3 in the first and second embodiments are preferable to the one in this embodiment in that the former is lower in cost in terms of structure than the latter.

Embodiment 4

Next, the heater in another embodiment of the present invention is described. The heater 3 in the first embodiment was structured so that the current to be supplied to the four heat generation resistors 6*a*, 6*b*, 6*c* and 6*d* is controlled with the use of only the single triac 11. The heater 3 in this embodiment is structured so that the current to be supplied to the upstream two heat generation resistors 6*a* and 6*b* in terms of the recording medium conveyance direction a is controlled by the triac 11, whereas the current to be supplied to the downstream two heat generation resistors 6*c* and 6*d* is controlled by the triac 12.

The heater 3 in this embodiment is the same in structure as the heater 3 in the first embodiment. Further, the electrical resistance amounts R1, R2, R3 and R4 of the heat generation resistors 6*a*, 6*b*, 6*c* and 6*d*, respectively, in this embodiment are the same as those in the first embodiment. That is, R1=R2=30Ω, and R3=R4=45Ω. That is, R1<R3.

Figure 10:
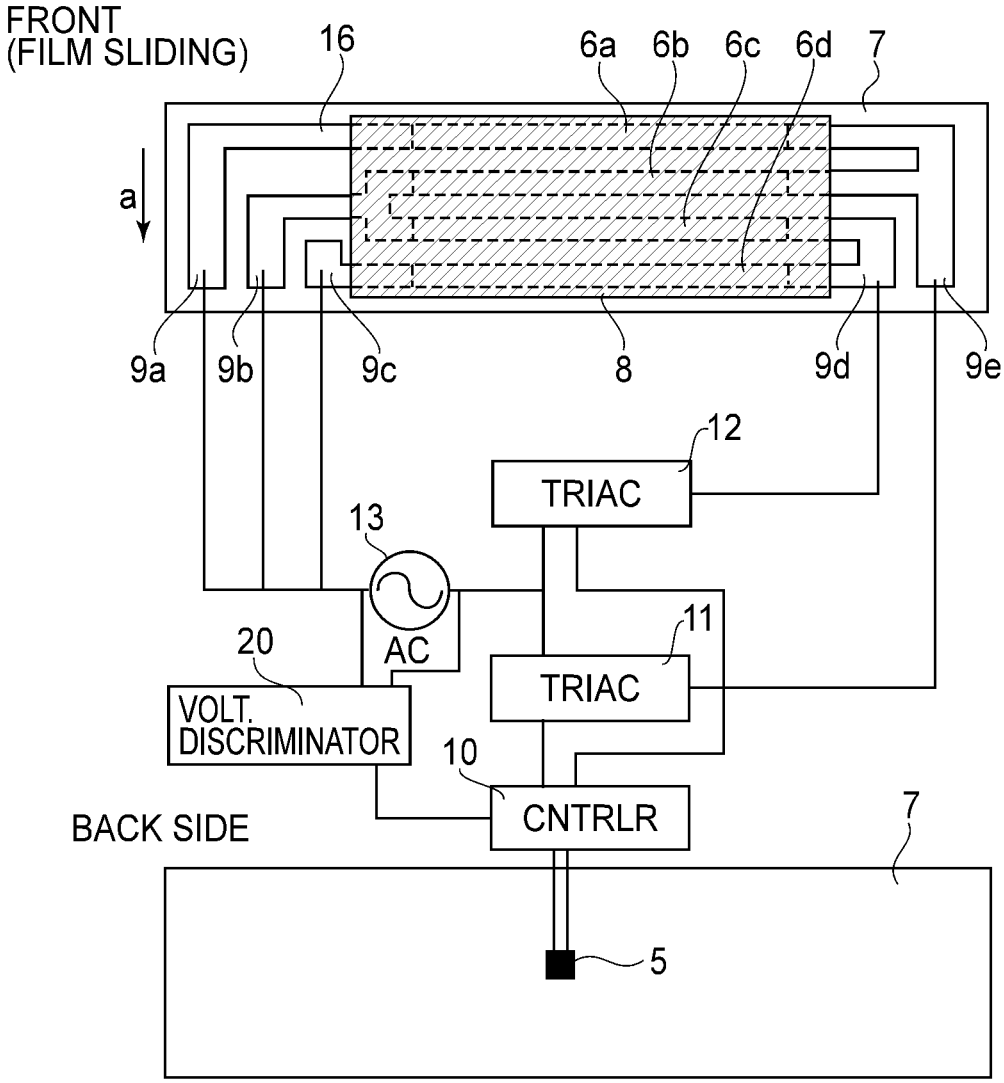
FIG. 10 is a combination of a plan view of the heater of the fixing apparatus in the fourth embodiment, and a current control circuit of the heater.

FIG. 10 is a combination of a plan view of the heater 3 in this embodiment, and a diagram of the current control circuit of the heater 3. For the sake of simplification, FIG. 10 shows only the current path of the current control circuit, which is created when the power source 13 is in the 100 V category.

The current control circuit of the heater 3 in the first embodiment had only one triac 11, whereas the current control circuit of the heater 3 in this embodiment has two triacs 11 and 12. The current control circuit of the heater 3 in this embodiment is also provided with a voltage discrimination circuit 20 for determining whether the power source is in a 100 V category or 200 V category.

Figure 11:
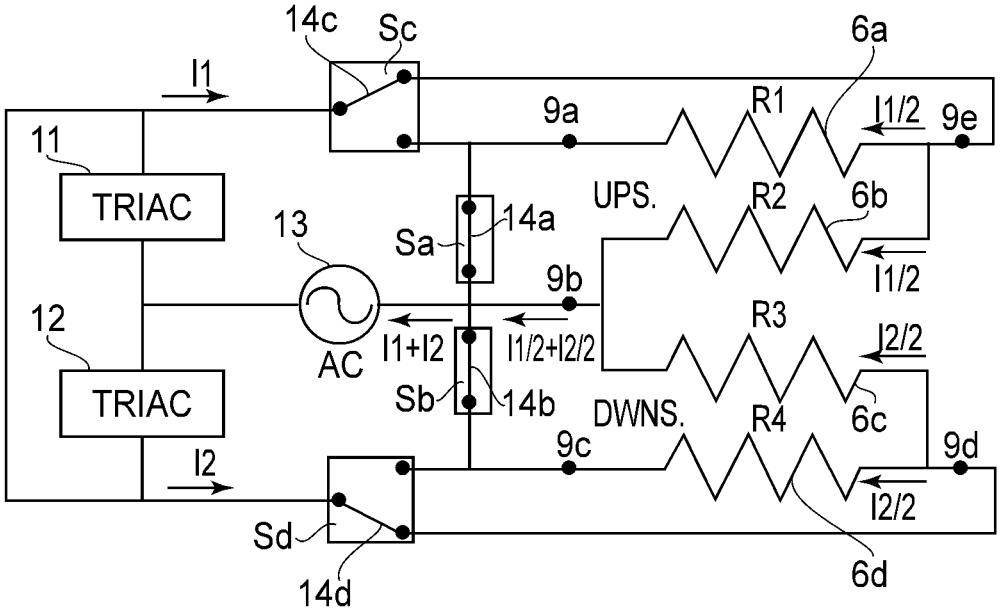
FIG. 11 is a diagram of the current control circuit of the heater in the fourth embodiment, and shows the current paths.
Figure 11:
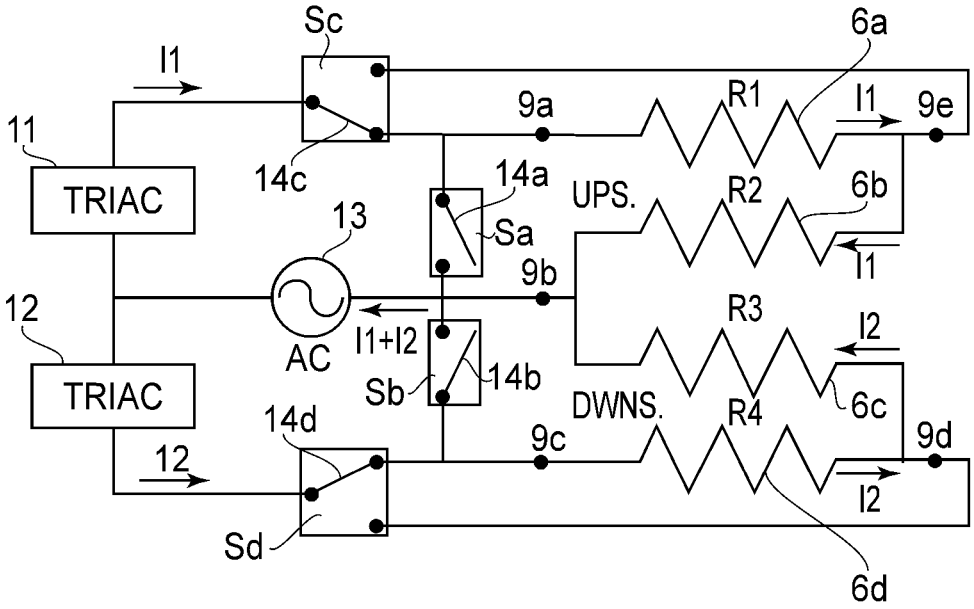

FIG. 11 is a diagram for describing the current paths of the current control circuit of the heater 3 in this embodiment. More specifically, FIG. 11(A) is a diagram of the current path of the current control circuit when the power source voltage is in the 100 V category, and FIG. 14(B) is a diagram of the current path of the current control circuit when the power source is in the 200 V category.

The current control circuit in this embodiment has two independent current paths which are directly in connection to a power source 13. More specifically, the top current path shown in FIG. 11 is in connection to the upstream two heat generation resistors 6*a* and 6*b*, in terms of the recording medium conveyance direction a, through a triac 11, whereas the bottom current path is in connection to the downstream two heat generation resistors 6*c* and 6*d*, in terms of the recording medium conveyance direction a, through a triac 12. Hereafter, the current which flows through the top current path shown in FIG. 11 will be referred to as a current I1, whereas the current which flows though the bottom current path shown in FIG. 11 will be referred to as a current I2. The current to be supplied to the upstream heat generation resistors 6*a* and 6*b* is controlled by the triac 11, whereas the current to be supplied to the downstream heat generation resistors 6*c* and 6*d* is controlled by the triac 12.

The current control circuit in this embodiment is the same in structure as the one in the first embodiment, except for the structural arrangement described above. In the case of the control section 10 in this embodiment, the triac which the top current path comprises is different from the triac which the bottom current path comprises; the top and bottom current paths comprises the triacs 11 and 12, respectively. However, the two triacs 11 and 12 are the same in output. For example, if the amount of thermal output necessary to maintain the temperature of the fixation nip N at a preset level (fixation level) is 50% of the full output of the heater 3, both the triacs 11 and 12 are controlled by the control section 10 so that their output becomes 50%.

As the control section 10 receives signals which are outputted from the voltage discrimination circuit 20 to indicate that the image forming apparatus is in connection with a power source in the 100 V category, it controls the switches Sa, Sb, Sc and Sd in the same manner as the control section 10 in the first embodiment does (FIG. 11(A)). Thus, the upstream two heat generation resistors 6*a* and 6*b* are connected in parallel, and so are the downstream two heat generation resistors 6*c* and 6*d*. Further, the combination of the upstream heat generation resistors 6*a* and 6*b*, and the combination of the downstream heat generation resistors 6*c* and 6*d*, are connected in parallel. Consequently, all four heat generation resistors 6*a*, 6*b*, 6*c* and 6*d* become connected in parallel.

Thus, the overall amount of electrical resistance of the combination of the upstream two heat generation resistors 6*a* and 6*b* is 15Ω, and the overall amount of electrical resistance of the combination of the downstream two heat generation resistors 6*c* and 6*d* is 22.5Ω. Further, the overall amount of electrical resistance of the combination of the four heat generation resistors 6*a*, 6*b*, 6*c* and 6*d* is 9Ω. Since R1=R2, the amount of current which flows through each of the upstream two heat generation resistors 6*a* and 6*b* becomes I1/2. Similarly, since R3=R4, the amount of current which flows through each of the downstream two heat generation resistors 6*c* and 6*d* becomes I2/2.

Supposing here that the combination of the heat generation resistors 6*a* and 6*b* is a single upstream heat generation resistor, and also, that the combination of the heat generation resistors 6*c* and 6*d* is a single downstream heat generation resistor, the ratio in terms of the amount of electrical resistance between the upstream heat generation resistor (combination of heat generation resistors 6*a* and 6*b*) and the downstream heat generation resistor (combination of heat generation resistors 6*c* and 6*d*) is: R1/2:R3/2=1:1.5. Since the upstream heat generation resistor (combination of heat generation resistors 6*a* and 6*b*) and downstream heat generation resistor (combination of heat generation resistors 6*c* and 6*d*) are connected in parallel, and are the same in the amount of current supplied thereto. Therefore, the ratio in the amount of heat generation between the upstream and downstream heat generation resistors is 1.5:1 (which is the same as ratio in first embodiment).

As the control section 10 receives signals which are outputted from the voltage discrimination circuit 20 to indicate that the image forming apparatus is in connection with a power source which is in the 200 V category, it controls the switches Sa, Sb, Sc and Sd in the same manner as the control section 10 in the first embodiment does (FIG. 11(B)). Consequently, the upstream heat generation resistors 6*a* and 6*b* become serially connected, and so are the downstream heat generation resistors 6*c* and 6*d*. Further, the combination of the upstream two heat generation resistors 6*a* and 6*b*, and the combination of the downstream two heat generation resistors 6*c* and 6*d*, are connected in parallel, as they are when the power source is in the 100 V category.

When the power source is in the 200 V category, the overall amount of electrical resistance of the combination of the upstream two heat generation resistors 6*a* and 6*b* is 60Ω, and the overall amount of electrical resistance of the combination of the downstream two heat generation resistors 6*c* and 6*d* is 90Ω. Further, the overall amount of electrical resistance of the combination of the four heat generation resistors 6*a*, 6*b*, 6*c* and 6*d* is 36Ω. Further, when the power source is in the 200 V category, both the amount of current which flows through the heat generation resistor 6*a*, and that through the heat generation resistor 6*b*, are I1, and both the amount of current which flows through the heat generation resistor 6*c* and that through the heat generation resistor 6*d*, are I2.

The heater 3 in this embodiment can also make the ratio in the amount of heat generation between the upstream and downstream heat generation resistors 1.5:1 as can the heater 3 in the first embodiment, and therefore, it can keep the position X of the peak of the heat distribution in the fixation nip N, at roughly the widthwise center of the fixation nip N. Therefore, the fixing device 107 which employs the heater 3 in this embodiment can also obtain the same operational effects as those obtainable by the fixing device 107 in the first embodiment.

Also in the case of the heater 3 in this embodiment, the ratio in the amount of heat generation between the upstream and downstream heat generation resistors has only to be set to be optimal by changing the ratio between the amount of electrical resistance R1 of the heat generation resistor 6*a* and the amount of electrical resistance R3 of the heat generation resistor 6*c*, according to the specifications of a fixing device which employs the heater 3 in this embodiment.

Embodiment 5

Next, the heater 3 in another embodiment of the present invention is described. In the case of the heater 3 in the fourth embodiment, the current to be supplied to the upstream two heat generation resistors 6*a* and 6*b* is controlled by the triac 11, whereas the current to be supplied to the downstream two heat generation resistors 6*c* and 6*d* is controlled by the triac 12. Further, the four heat generation resistors are the same in the amount of the current with which they are supplied. In this embodiment, the current control circuit of the heater 3 is structured like the one in the second embodiment, but, the amount of current to be supplied to the upstream two heat generation resistors 6*a* and 6*b* is made different from that to be supplied to the downstream two heat generation resistors 6*c* and 6*d*.

The heater 3 in this embodiment is the same in structure as the heater 3 in the first embodiment. The current control circuit of the heater 3 in this embodiment is the same in structure as the current control circuit of the heater 3 in the second embodiment. The heat generation resistors 6*a*, 6*b*, 6*c* and 6*d* of the heater 3 in this embodiment are different in the amount of electrical resistance from the counterparts of the heater 3 in the first embodiment, respectively. In comparison, in the case of the heater 3 in this embodiment, the amounts of electrical resistances R1, R2, R3 and R4 of the four heat generation resistors 6*a*, 6*b*, 6*c* and 6*d*, respectively, are all 36Ω, and R1=R3. The control circuit 10 of the heater 3 in this embodiment is different from that of the heater 3 in the second embodiment in the current controlling method.

The control circuit 10 of the heater 3 in this embodiment is the same in structure as that of the heater 3 in the second embodiment (FIG. 11). Therefore, when the power source is in the 100 V category (FIG. 11(A)), the overall amount of the electrical resistance of the combination of the upstream two heat generation resistors 6*a* and 6*b* is 18Ω, and the overall amount of the electrical resistance of the combination of the downstream two heat generation resistors 6*c* and 6*d* is also 18Ω. Further, the overall amount of electrical resistance of the combination of the four heat generation resistors 6*a*, 6*b*, 6*c* and 6*d* is 9Ω. When the power source voltage is in the 200 V category (FIG. 11(B)), the overall amount of electrical resistance of the combination of the upstream two heat generation resistors 6*a* and 6*b* is 64Ω, and so is the overall amount of the combination of the downstream two heat generation resistors 6*c* and 6*d*. Further, the overall amount of the combination of the four heat generation resistors 6*a*, 6*b*, 6*c* and 6*d* when the power source is in the 100 V category is the same as that of the counterpart of the comparative heater 3, and the overall amount of the combination of the four heat generation resistors 6*a*, 6*b*, 6*c* and 6*d* when the power source is in the 200 V category is the same as that of the heater 3 in the second embodiment.

Also in this embodiment, the current supply to the upstream two heat generation resistors 6*a* and 6*b* is controlled by the triac 11, the current supply to the downstream two heat generation resistors 6*c* and 6*d* is controlled by the triac 12, as they are in the second embodiment. However, in this embodiment, the two triacs 11 and 12 are made different in output so that the ratio between the amount of current supply to the upstream two heat generation resistors 6*a* and 6*b* and the amount of current supply to the downstream two heat generation resistors 6*c* and 6*d*, that is, the ratio in thermal output between the combination of the upstream two heat generation resistors 6*a* and 6*b*, and the combination of downstream two heat generation resistors 6*c* and 6*d* becomes 1.5:1.

As for the structural arrangement for making the triacs 11 and 12 different in output, two triacs different in output may be employed as the triacs 11 and 12, one for one, or two triacs which are the same in rated output, but can be changed in the amount of output by the control section 10 may be employed as the triacs 11 and 12, one for one.

Here, a case in which the amount of thermal output of the heater 3, which is necessary to maintain the temperature of the fixation nip N at a preset level (fixation level) is 50%, for example, (100% when all four heat generation resistors 6*a*, 6*b*, 6*c* and 6*d* are supplied with full amount of current) of the full thermal output of the combination of all four heat generation resistors 6*a*, 6*b*, 6*c* and 6*d* is described. It is assumed here that the combined thermal output of the upstream two heat generation resistors 6*a* and 6*b* is 60% (100% when upstream two heat generation resistors 6*a* and 6*b* are supplied with full amount of current), and the combined thermal output of the downstream two heat generation resistors 6*c* and 6*d* is 40% (100% when downstream two heat generation resistors 6*c* and 6*d* are supplied with full amount of current).

Supposing here that the combination of the heat generation resistors 6*a* and 6*b* is a single upstream heat generation resistor, and also, that the combination of the heat generation resistors 6*c* and 6*d* is a single downstream heat generation resistor, the ratio in the amount of electrical resistance between the upstream heat generation resistor (combination of heat generation resistors 6*a* and 6*b*) and the downstream heat generation resistor (combination of heat generation resistors 6*c* and 6*d*) is made the same. Therefore, the ratio in the amount of heat generation between the upstream heat generation resistor (combination of heat generation resistors 6*a* and 6*b*) and downstream heat generation resistor (combination of heat generation resistors 6*c* and 6*d*) can be made to be 1.5:1 by making the ratio between the amount of current supply to the upstream heat generation resistor (combination of heat generation resistors 6*a* and 6*b*) and that to the downstream heat generation resistors (combination of heat generation resistors 6*c* and 6*d*) 1.5:1.

Also in the case of the heater 3 in this embodiment, the ratio in the amount of heat generation between the upstream and downstream heat generation resistors 1.5:1 as in the case of the heater 3 in the first embodiment. Therefore, it is possible to keep the position X of the peak of the heat distribution of the fixation nip N in the widthwise direction, roughly at the center of the widthwise center of the fixation nip N. Thus, a fixing device 107 which employs the heater 3 in this embodiment can also provide the same operation effects as those obtainable by the fixing device 107 in the first embodiment.

In the case of the heaters 3 in the first and second embodiments, the ratio between the amount of electrical resistance R1 of the heat generation resistor 6*a* and the amount of electrical resistance R3 of the heat generation resistor 6*c* had to be changed in order to change the ratio in the amount of heat generation between the upstream and downstream combinations of heat generation resistors. In comparison, in the case of the heater 3 in this embodiment, the heat generation ratio can be set with the use of software alone, that is, without changing hardware.

As described above, the distance (distance between X and Y in FIG. 6) by which the point on the surface of the heater 3, which is highest in temperature in terms of the recording medium conveyance direction, changes in response to the change in the recording medium conveyance speed. Thus, the heater 3 in this embodiment can be employed by an image forming apparatus which has multiple process speeds (recording medium conveyance speeds) and can be switched in process speed in response to a command from a user, so that the heat generation ratio between the upstream and downstream heat generation resistors can be optimally set in response to the change in process speed. As for an example of optimally setting the heat generation ratio in response to the change in process speed, there is a case in which, for one of the two process speeds, the heat generation ratio is set to 1.5:1, whereas for the other process speed, it is set to 2:1. From the standpoint the feature described above, the heater 3 in this embodiment is superior to any of the heaters 3 in the first to fourth embodiments.

[Miscellanies]

The usage of the fixing apparatuses (devices) in the first and second embodiments is not limited to the usage as a fixing apparatus (device) for thermally fixing an unfixed toner image to a sheet of recording medium. For example, they can also be used as an image heating apparatus for temporarily fixing an unfixed toner image to a sheet of recording medium by heating the image, or an image heating apparatus for increasing in gloss a thermally fixed image on a sheet of recording medium, by heating the toner image.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 166699/2011 filed Jul. 29, 2011 which is hereby incorporated by reference.

What is claimed is:

1. An image heating apparatus comprising:

an endless belt;

a heater contacting an inner surface of said endless belt and having a substrate and a plurality of heat generating resistors configured to generate heat using commercial electric power; and a pressing member configured to cooperate with said heater through said endless belt to form a nip for nipping and feeding a recording material;

wherein said heater includes a first heat generating resistor having a resistance R1, a second heat generating resistor having a resistance R2, a third heat generating resistor having a resistance R3 and a fourth heat generating resistor having a resistance R4, arranged in the order named from an upstream side in a feeding direction of the recording material, and R1=R2 and R3=R4, wherein a connection state of said heat generating resistors is switchable between a first connection state in which said first heat generating resistor and said second heat generating resistor are connected in parallel, said third heat generating resistor and said fourth heat generating resistor are connected in parallel, and a set of said first heat generating resistor and said second heat generating resistor and a set of said third heat generating resistor and said fourth heat generating resistor are connected in parallel, and a second connection state in which said first heat generating resistor and said second heat generating resistor are connected in series, said third heat generating resistor and said fourth heat generating resistor are connected in series, and a set of said first heat generating resistor and said second heat generating resistor and a set of said third heat generating resistor and said fourth heat generating resistor are connected in parallel.

2. An apparatus according to claim 1, wherein said first connection state is for a case in which the commercial electrical power is a 100 volt type, and said second connection state is for a case in which electrical power is a 200 volt type.

3. An apparatus according to claim 2, further comprising a power source voltage detecting portion configured to detect a voltage of the commercial electric power, wherein said first connection state and said second connection state are automatically selected in accordance with an output of said power source voltage detecting portion.

4. An apparatus according to claim 1, wherein the resistance R1 and the resistance R3 satisfy R1<R3.

5. An apparatus according to claim 4, wherein electric power supplies to said first to fourth heat generating resistors are controlled by a TRIAC.

6. An apparatus according to claim 1, wherein electric power supplies to said first and second heat generating resistors are controlled by a first TRIAC, and electric power supplies to said third and fourth heat generating resistors are controlled by a second TRIAC.

7. An apparatus according to claim 6, wherein the resistance R1 is equal to the resistance R3.

8. An apparatus according to claim 7, wherein said first TRIAC and said second TRIAC are controlled such that an amount of heat generation of said first heat generating resistor is larger than that of said third heat generating resistor.

* * * * *